US009176429B2

(12) United States Patent
Yamagishi et al.

(10) Patent No.: US 9,176,429 B2
(45) Date of Patent: Nov. 3, 2015

(54) DEVELOPING DEVICE AND IMAGE FORMING APPARATUS PROVIDED WITH SAME

(71) Applicant: KYOCERA Document Solutions Inc., Osaka-shi, Osaka (JP)

(72) Inventors: Yoshihiro Yamagishi, Osaka (JP); Hiroshi Yamazaki, Osaka (JP); Masaki Hayashi, Osaka (JP); Eiji Nimura, Osaka (JP); Koji Kuramashi, Osaka (JP)

(73) Assignee: KYOCERA Document Solutions Inc. (JP)

( * ) Notice: Subject to any disclaimer, the term of this patent is extended or adjusted under 35 U.S.C. 154(b) by 177 days.

(21) Appl. No.: 13/899,870

(22) Filed: May 22, 2013

(65) Prior Publication Data

US 2013/0315632 A1 Nov. 28, 2013

(30) Foreign Application Priority Data

May 25, 2012 (JP) ..... 2012-119253

(51) Int. Cl.
*G03G 15/08* (2006.01)

(52) U.S. Cl.
CPC ..... *G03G 15/0891* (2013.01); *G03G 15/0893* (2013.01)

(58) Field of Classification Search
CPC ..... G03G 15/0891; G03G 15/0893
USPC ..... 399/254, 263
See application file for complete search history.

(56) References Cited

U.S. PATENT DOCUMENTS 5,842,090 A * 11/1998 Mikawa ..... 399/256
2009/0092419 A1* 4/2009 Iwata et al. ..... 399/254

FOREIGN PATENT DOCUMENTS

JP 03-265877 11/1991
JP 2004-307140 11/2004
JP 2012-032718 2/2012

OTHER PUBLICATIONS

Japanese Office Action—Jul. 1, 2014.

* cited by examiner

*Primary Examiner* — David Gray
*Assistant Examiner* — Andrew V Do
(74) *Attorney, Agent, or Firm* — Gerald E. Hespos; Michael J. Porco; Matthew T. Hespos

(57) ABSTRACT

A developing device includes a housing, a developing roller, a developer supply path, a developer conveyance path, a supply-side conveying member, an agitating side conveying member and first projection members. The developing roller is rotatably supported in the housing. The supply-side conveying member includes a supply-side spiral member formed by connecting spiral pieces, in the first direction and having a hollow interior formed by the connected spiral pieces and a first rib member extending in the first direction, is arranged in the developer supply path and conveys the developer in the first direction by being driven and rotated. The first projecting members extend in the first direction along an outer wall portion of the first rib member from a first area where the supply-side spiral member and the first rib member intersect and project radially outward in the rotation of the supply-side conveying member.

16 Claims, 13 Drawing Sheets

DEVELOPING DEVICE AND IMAGE FORMING APPARATUS PROVIDED WITH SAME

This application is based on Japanese Patent Application Serial No. 2012-119253 filed with the Japan Patent Office on May 25, 2012, the contents of which are hereby incorporated by reference.

BACKGROUND

The present disclosure relates to a developing device in which developer is conveyed and an image forming apparatus provided with the same.

Conventionally, a developing device is known in which developer is conveyed in a circulating manner between a first conveyance path and a second conveyance path arranged in a developer housing. The developer is conveyed in opposite directions in the first and second conveyance paths by agitating screws arranged in the respective first and second conveyance paths. The agitating screw of the developing device is composed of a shaft portion and a spiral piece arranged around the shaft portion. In the developer housing, the developer is conveyed in a predetermined conveying direction by driving and rotating the agitating screws.

If an adhesion force of the developer increases as the developer is deteriorated, the developer may adhere to the shaft portion. If the developer adheres to the shaft portion, virtual shaft thickening of the agitating screw occurs to reduce the conveying performance of the agitating screw. An agitating screw including no shaft part, i.e. having a hollow shape in an axial central part thereof to solve the shaft thickening of the agitating screw described above is known.

With the agitating screw described above, developer conveying performance in an axial direction tends to be lower as compared with an agitating screw including a shaft portion extending in the axial direction. Thus, the conveying performance in the axial direction of the agitating screw has been affected by surrounding members in some cases. Particularly, with the agitating screw arranged adjacent to a developing roller for carrying developer with a magnetic force, the conveying performance of the agitating screw is subject to fluctuation depending on the developing roller. As a result, there has been a difference in the conveying performance between the agitating screw arranged in the first conveyance path adjacent to the developing roller and that arranged in the second conveyance path distant from the developing roller in some cases. This has resulted in a problem that the circulation of the developer in the developer housing becomes unstable.

The present disclosure was developed in view of the above problem and an object thereof is to adjust a conveying ability of a developer conveying member having a hollow shape by a simple configuration.

SUMMARY

A developing device according to one aspect of the present disclosure includes a housing, a developing roller, a developer supply path, a developer conveyance path, a pair of communication paths, a supply-side conveying member, an agitating-side conveying member, and first projection members or second projection members. The housing includes a pair of wall portions. The developing roller is rotatably supported in the housing between the pair of wall portions and carries developer. The developer supply path is arranged along the developing roller and configured such that the developer is conveyed in a first direction and supplied to the developing roller. The developer conveyance path is arranged along the developer supply path and configured such that the developer is conveyed in a second direction opposite to the first direction while being agitated. The pair of communication paths are arranged at inner sides of the pair of wall portions and allow communication between end parts of the developer conveyance path and end parts of the developer supply path. The supply-side conveying member includes a supply-side spiral member formed by connecting spiral pieces, each forming one spiral turn, in the first direction and having a hollow interior formed by the connected spiral pieces and a first rib member extending in the first direction and bridging adjacent ones of the spiral pieces of the supply-side spiral member, is arranged in the developer supply path and conveys the developer in the first direction by being driven and rotated. The agitating-side conveying member includes an agitating-side spiral member formed by connecting spiral pieces, each forming one spiral turn, in the second direction and having a hollow interior formed by the connected spiral pieces and a second rib member extending in the second direction and bridging adjacent ones of the spiral pieces of the agitating-side spiral member, is arranged in the developer conveyance path and conveys the developer in the second direction by being driven and rotated. The first projecting members extend in the first direction along an outer wall portion of the first rib member from a first area where the supply-side spiral member and the first rib member intersect and project radially outward in the rotation of the supply-side conveying member. Further, the second projection members extend in the second direction along an outer wall portion of the second rib member from a second area where the agitating-side spiral member and the second rib member intersect and project radially outward in the rotation of the agitating-side conveying member.

Further, an image forming apparatus according to another aspect of the present disclosure includes the above developing device and an image bearing member. The image bearing member is configured such that an electrostatic latent image is to be formed on a circumferential surface, and arranged to face the developing roller.

These and other objects, features and advantages of the present disclosure will become more apparent upon reading the following detailed description along with the accompanying drawings.

DETAILED DESCRIPTION

Figure 1:
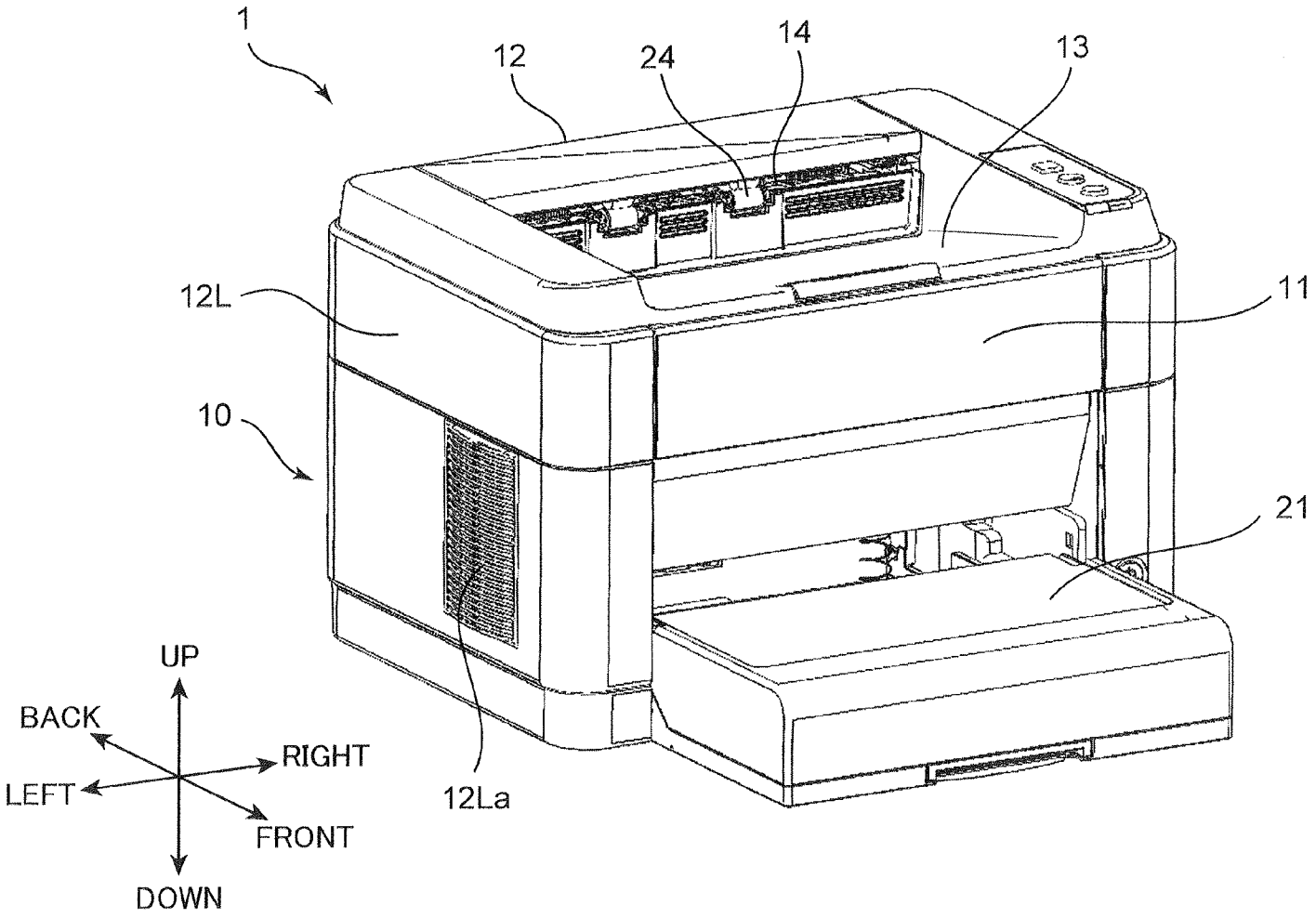
FIG. 1 is a perspective view showing the external appearance of an image forming apparatus according to one embodiment of the present disclosure.
Figure 2:
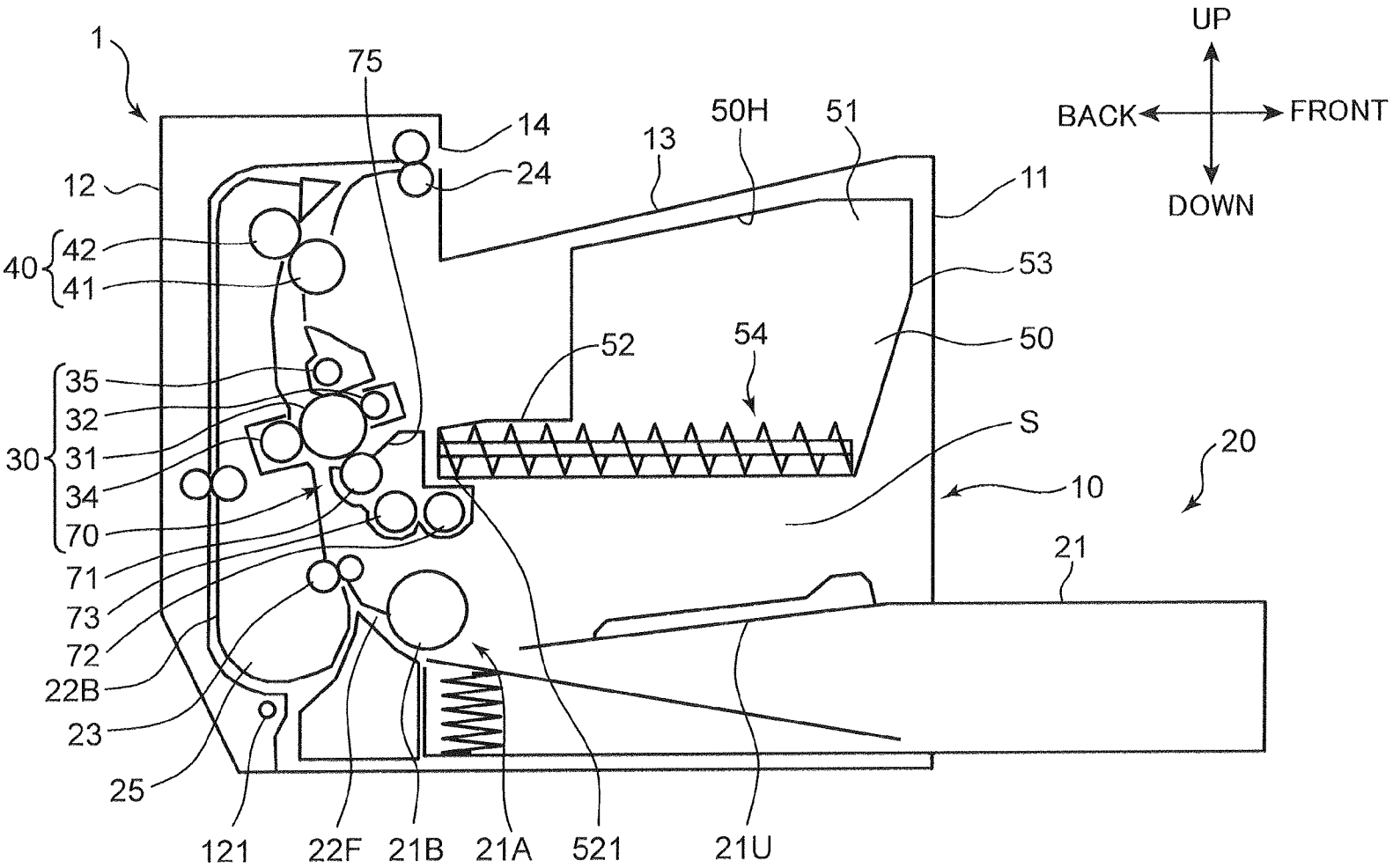
FIG. 2 is a sectional view showing the internal structure of the image forming apparatus according to the embodiment of the present disclosure.

Hereinafter, embodiments of the present disclosure are described with reference to the drawings. FIG. 1 is a perspective view showing the external appearance of an image forming apparatus 1 according to one embodiment of the present disclosure. FIG. 2 is a side view in section showing the internal structure of the image forming apparatus 1 according to one embodiment of the present disclosure. Although a black-and-white printer is illustrated as the image forming apparatus 1 here, the image forming apparatus may be a copier, a facsimile machine or a complex machine provided with these functions, or an image forming apparatus for forming a color image.

The image forming apparatus 1 includes a main body housing having a substantially rectangular parallelepipedic housing structure, and a sheet feeding unit 20, an image forming unit 30, a fixing unit 40 and a toner container 50 housed in this main body housing 10.

A front cover 11 and a rear cover 12 are respectively provided on a front surface side and a rear surface side of the main body housing 10. By opening the front cover 11, the toner container 50 is exposed to the front side. This enables a user to take out the toner container 50 from the front surface side of the main body housing 10 when toner runs out. The rear cover 12 is a cover which is opened at the time of a sheet jam or maintenance. The respective image forming unit 30 and fixing unit 40 can be taken out from the rear surface side of the main body housing 10 by opening the rear cover 12. Further, a left cover 12L (FIG. 1) and a right cover 12R (not shown in FIG. 1) opposite to the left cover 12L are respectively so arranged on side surfaces of the main body housing 10 as to extend in a vertical direction. An air inlet 12La through which air is taken into the main body housing 10 is arranged in a front part of the left cover 12L. Further, a sheet discharging portion 13 to which a sheet after image formation is to be discharged is provided on the upper surface of the main body housing 10. Various devices for performing image formation are housed in an inner space S (FIG. 2) defined by the front cover 11, the rear cover 12, the left cover 12L, the right cover 12R and the sheet discharging portion 13.

The sheet feeding unit 20 includes a sheet cassette 21 for storing sheets to which an image forming process is to be applied (FIG. 2). Apart of this sheet cassette 21 projects further forward from the front surface of the main body housing 10. The upper surface of a part of the sheet cassette 21 housed in the main body housing 10 is covered by a sheet cassette ceiling plate 21U. The sheet cassette 21 includes a sheet storage space in which a stack of the sheets is stored, a lift plate for lifting up the stack of sheets for sheet feeding, and the like. A sheet pickup unit 21A is provided above a rear end side of the sheet cassette 21. A feed roller 21B for picking up the uppermost sheet of the sheet stack in the sheet cassette 21 one by one is arranged in this sheet pickup unit 21A.

The image forming unit 30 performs an image forming process for forming a toner image on a sheet fed from the sheet feeding unit 20. The image forming unit 30 includes a photoconductive drum 31 (image bearing member) and a charging device 32, an exposure device (not shown in FIG. 2), a developing device 70, a transfer roller 34 and a cleaning device 35 arranged around this photoconductive drum 31. The image forming unit 30 is arranged between the left cover 12L and the right cover 12R.

The photoconductive drum 31 includes an unillustrated rotary shaft and a cylindrical surface (circumferential surface) which rotates about the rotary shaft. An electrostatic latent image is to be formed on this cylindrical surface and a toner image in conformity with this electrostatic latent image is to be carried on the cylindrical surface. A photoconductive drum made of an amorphous silicon (a-Si) based material can be used as the photoconductive drum 31. The photoconductive drum 31 is arranged to face a developing roller 71 to be described later.

The charging device 32 is for uniformly charging the surface of the photoconductive drum 31 and includes a charging roller held in contact with the photoconductive drum 31.

The cleaning device 35 includes an unillustrated cleaning blade, cleans the toner adhering to the cylindrical surface of the photoconductive drum 31 after the transfer of the toner image and conveys this toner to an unillustrated collecting device. Further, the photoconductive drum 31, the charging device 32 and the cleaning device 35 are integrally configured as an unillustrated drum unit.

The exposure device includes optical devices such as a laser light source, a mirror and a lens and irradiates the cylindrical surface of the photoconductive drum 31 with light modulated based on image data fed from an external apparatus such as a personal computer, thereby forming an electrostatic latent image.

The developing device 70 supplies toner to the cylindrical surface of the photoconductive drum 31 to develop the electrostatic latent image formed on the photoconductive drum 31 and form a toner image. The developing device 70 includes the developing roller 71 for bearing the toner to be supplied to the photoconductive drum 31 and a first conveyor screw 72 and a second conveyor screw 73 for conveying developer in a circulating manner while agitating the developer in an unillustrated developer housing. Note that the developing device 70 is described in detail later.

The transfer roller 34 is a roller for transferring the toner image formed on the cylindrical surface of the photoconductive drum 31 onto a sheet. The transfer roller 34 forms a transfer nip portion by coming into contact with the cylindrical surface of the photoconductive drum 31. A transfer bias having a polarity opposite to that of the toner is applied to this transfer roller 34.

The fixing unit 40 performs a fixing process for fixing a transferred toner image onto a sheet. The fixing unit 40 includes a fixing roller 41 internally provided with a heat source and a pressure roller 42 pressed in contact with this fixing roller 41 and forming a fixing nip portion between the fixing roller 41 and itself. When a sheet having a toner image transferred thereto is passed through the fixing nip portion, the toner image is fixed onto the sheet by heating by the fixing roller 41 and pressing by the pressure roller 42.

The toner container 50 stores the toner to be supplied to the developing device 70. The toner container 50 includes a container main body 51 as a main storage part for the toner, a tubular portion 52 projecting from a lower part of one side surface of the container main body 51, a lid member 53 covering the other side surface of the container main body 51, and a rotary member 54 housed in the container for conveying the toner. The toner stored in the toner container 50 is supplied into the developing device 70 through a toner discharge opening 521 provided on the lower surface of the leading end of the tubular portion 52 by driving and rotating the rotary member 54. Further, a container ceiling plate 50H covering an upper side of the toner container 50 is located below the sheet discharging portion 13.

A main conveyance path 22F and a reversing conveyance path 22B are provided to convey a sheet in the main body housing 10. The main conveyance path 22F extends from the sheet pickup unit 21A of the sheet feeding unit 20 to a sheet discharge opening 14 provided to face the sheet discharging portion 13 on the upper surface of the main body housing 10 by way of the image forming unit 30 and the fixing unit 40. The reversing conveyance path 22B is a conveyance path for returning a sheet, one side of which is printed, to a side of the main conveyance path 22F upstream of the image forming unit 30 in the case of printing both sides of the sheet.

The main conveyance path 22F extends to pass the transfer nip portion formed by the photoconductive drum 31 and the transfer roller 34 from a lower side to an upper side. Further, a pair of registration rollers 23 are arranged in a side of the main conveyance path 22F upstream of the transfer nip portion. A sheet is temporarily stopped at the pair of registration rollers 23 and fed to the transfer nip portion at a predetermined timing for image transfer after a skew correction is made. A plurality of conveyor rollers for conveying a sheet are arranged at suitable positions of the main conveyance path 22F and the reversing conveyance path 22B, and a pair of discharge rollers 24 are arranged, for example, near the sheet discharge opening 14.

The reversing conveyance path 22B is formed between the outer side surface of a reversing unit 25 and the inner surface of the rear cover 12 of the main body housing 10. Note that the transfer roller 34 and one of the pair of registration rollers 23 are mounted on the inner side surface of the reversing unit 25. The rear cover 12 and the reversing unit 25 are respectively rotatable about a supporting point portion 121 provided at the lower ends thereof. If a sheet jam occurs in the reversing conveyance path 22B, the rear cover 12 is opened. If a sheet jam occurs in the main conveyance path 22F or if the unit including the photoconductive drum 31 or the developing device 70 is taken out to the outside, the reversing unit 25 is also opened in addition to the rear cover 12.

<Detailed Configuration of Developing Device>

Figure 3B:
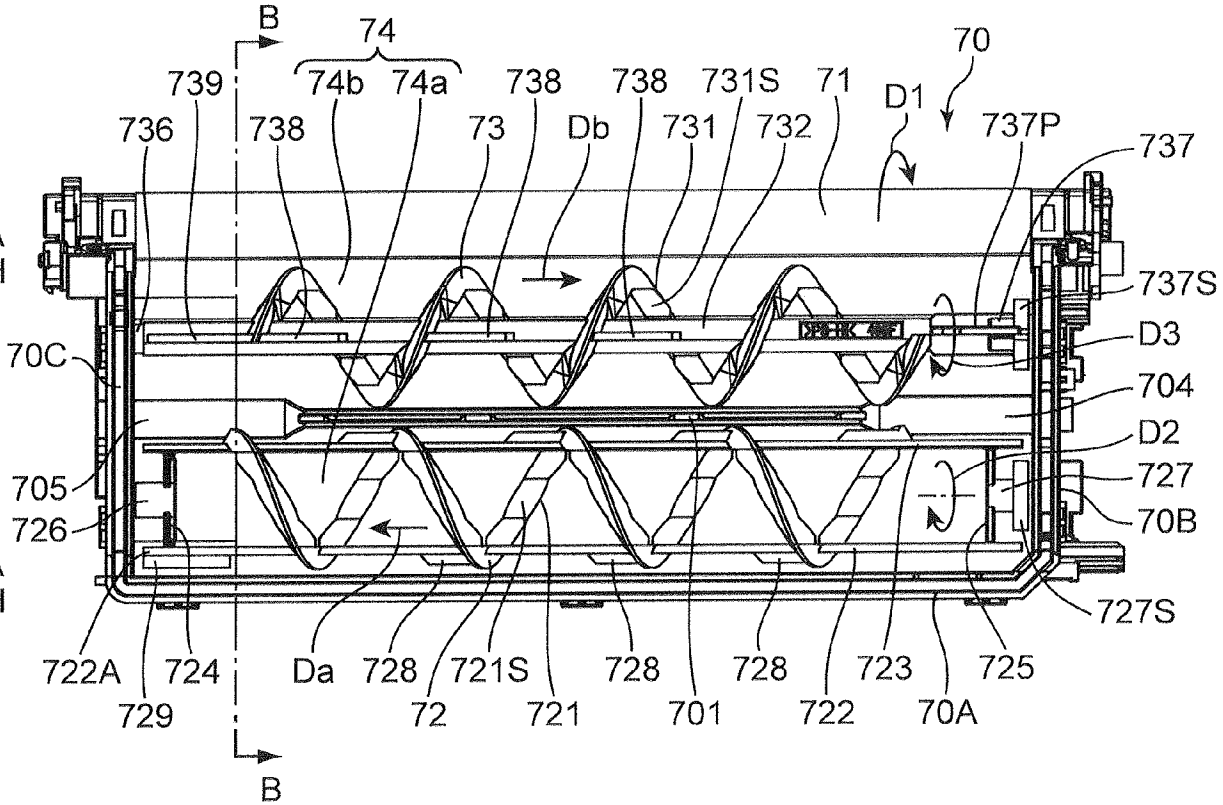
FIG. 3A is a sectional view and FIG. 3B is a plan view showing the internal structure of a developing device according to the embodiment of the present disclosure.
Figure 3A:
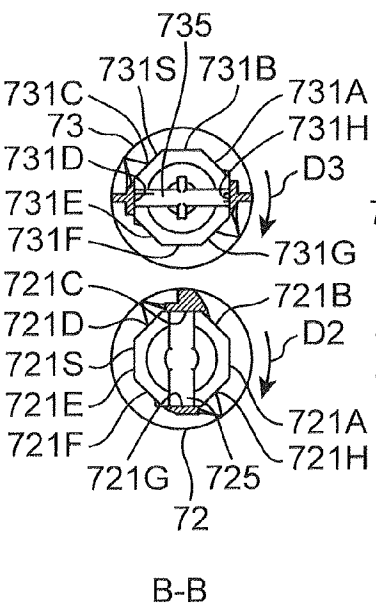

Next, with reference to FIG. 3, the configuration of the developing device 70 according to this embodiment is described in detail. FIG. 3A is a sectional view of the first and second conveyor screws 72, 73 arranged in the developing device 70 and FIG. 3B is a plan view of a developer housing 70A of the developing device 70. Note that FIG. 3B shows a state where a lid portion (not shown) of the developer housing 70A is removed.

The developing device 70 includes the developer housing 70A (housing) defining an inner space of the developing device 70. The developer housing 70A includes the unillustrated lid portion for covering respective rollers housed therein from above and a bottom portion connected to the lid portion and forming a lower surface portion of the developer housing 70A. Note that a bottom side of the developer housing 70A appears in FIG. 3B. The developer housing 70A includes a first wall portion 70B and a second wall portion 70C which are a pair of wall portions.

This developer housing 70A includes a developer storage 74 which is a cavity for storing developer composed of magnetic toner and capable of conveying the developer while agitating it. Further, the developing roller 71, a developer restricting blade 75 (FIG. 2) arranged to face the developing roller 71 and the first conveyor screw 72 (agitating-side conveying member) and the second conveyor screw 73 (supply-side conveying member) for agitating and conveying the developer are arranged in the developer housing 70A.

The developer storage 74 includes two adjacent first conveying portion 74*a* (developer conveyance path) and second conveying portion 74*b* (developer supply path) extending in a longitudinal direction of the developing device 70 between the first and second wall portions 70B, 70C. The first and second conveying portions 74*a*, 74*b* are partitioned from each other by a partition plate 701 formed integrally to the bottom portion of the developer housing 70A and extending in the longitudinal direction. Further, the first and second conveying portions 74*a*, 74*b* communicate with each other via a first communicating portion 704 and a second communicating portion 705 at opposite end parts in the longitudinal direction (see FIG. 3B). The first and second communicating portions 704, 705 are arranged between the pair of first and second wall portions 70B, 70C and the partition plate 701.

The first conveyor screw 72 and the second conveyor screw 73 are respectively housed in the first conveying portion 74*a* and the second conveying portion 74*b* and agitate and convey the developer by being rotated about shafts. Specifically, the first and second conveyor screws 72, 73 are rotatably supported on the first and second wall portions 70B, 70C. In FIG. 3A, the first conveyor screw 72 is driven and rotated in a direction of an arrow D2. As a result, the first conveyor screw 72 conveys the developer in a direction of an arrow Da (second direction) in the first conveying portion 74*a*. On the other hand, the second conveyor screw 73 is driven and rotated in a direction of an arrow D3. As a result, the second conveyor screw 73 conveys the developer in a direction of an arrow Db (first direction) in the second conveying portion 74*b*. Specifically, the first and second conveyor screws 72, 73 are so set that developer conveying directions thereof are reversed from each other (opposite directions) in an axial direction. This causes the developer to be conveyed in a circulating manner between the first and second conveying portions 74*a*, 74*b* as shown by the arrows Da, Db in FIG. 3B while being agitated.

The developing roller 71 is arranged along the longitudinal direction of the developing device 70 and rotatably supported in the developer housing 70A. The developing roller 71 is arranged along the second conveyor screw 73. In FIG. 3B, the developing roller 71 is driven and rotated in a direction of an arrow D1. A fixed so-called magnet roll is arranged in the developing roller 71. The magnet roll includes a plurality of magnetic poles. The developer is supplied from the second conveyor screw 73 to the circumferential surface of the developing roller 71. Then, the developer carried on the circumferential surface of the developing roller 71 is conveyed to a downstream side in a rotation direction of the developing roller 71 as the developing roller 71 is rotated.

In a circumferential direction of the developing roller 71, the developer restricting blade 75 (FIG. 2) is arranged downstream of an area, where the developing roller 71 and the second conveyor screw 73 are facing each other, in the rotation direction of the developing roller 71. The developer restricting blade 75 extends in an axial direction of the developing roller 71 on the unillustrated lid portion of the developer housing 70A. The developer restricting blade 75 is a plate-like member, a leading end part of which is arranged at a predetermined distance from the circumferential surface of the developing roller 71. The thickness of a layer of the developer carried on the developing roller 71 is restricted by the developer restricting blade 75. The layer of the developer on the developing roller 71 restricted in thickness by the developer restricting blade 75 is conveyed to apart where the developing roller 71 and the photoconductive drum 31 are facing each other, and supplied to the cylindrical surface of the photoconductive drum 31 in accordance with an electrostatic latent image formed on the photoconductive drum 31.

Figure 4:
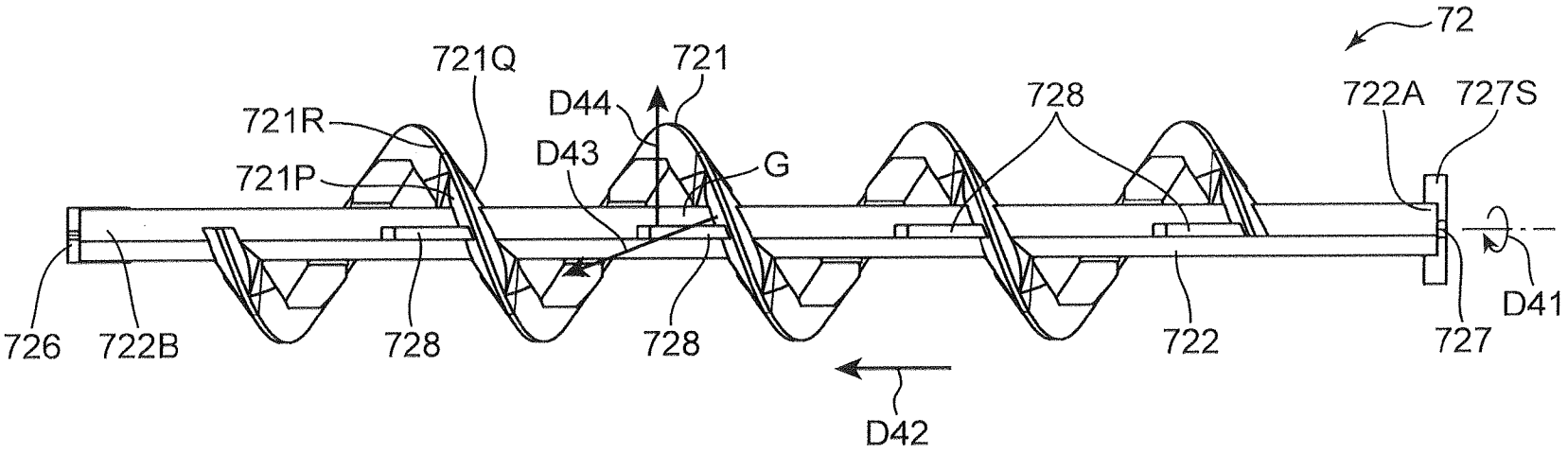
FIG. 4 is a front view of a conveyor screw according to the embodiment of the present disclosure.
Figure 5:
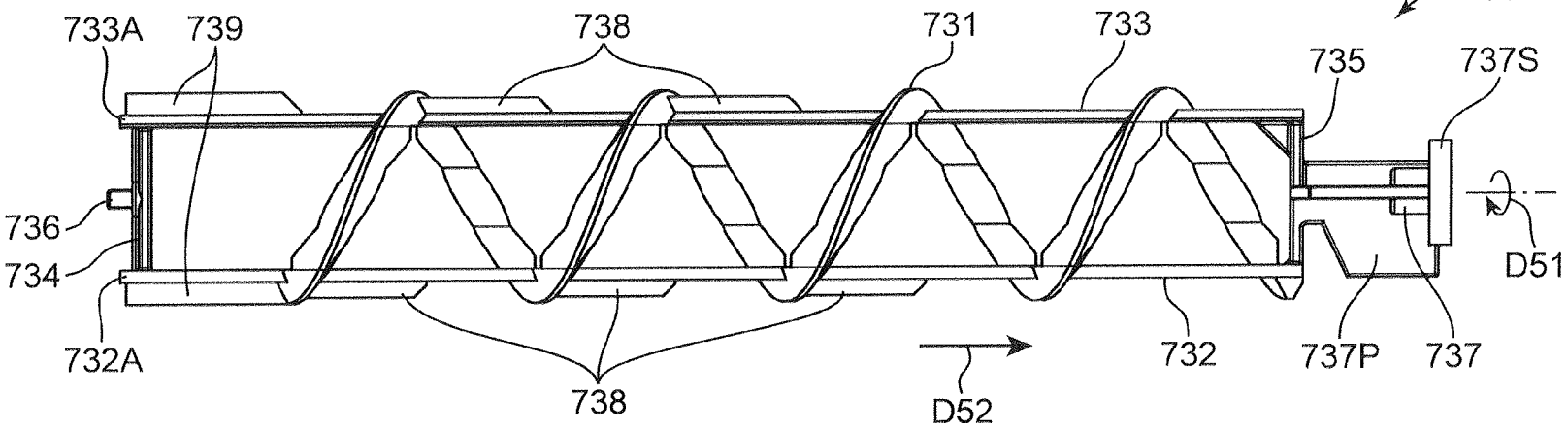
FIG. 5 is a plan view of a conveyor screw according to the embodiment of the present disclosure.
Figure 6:
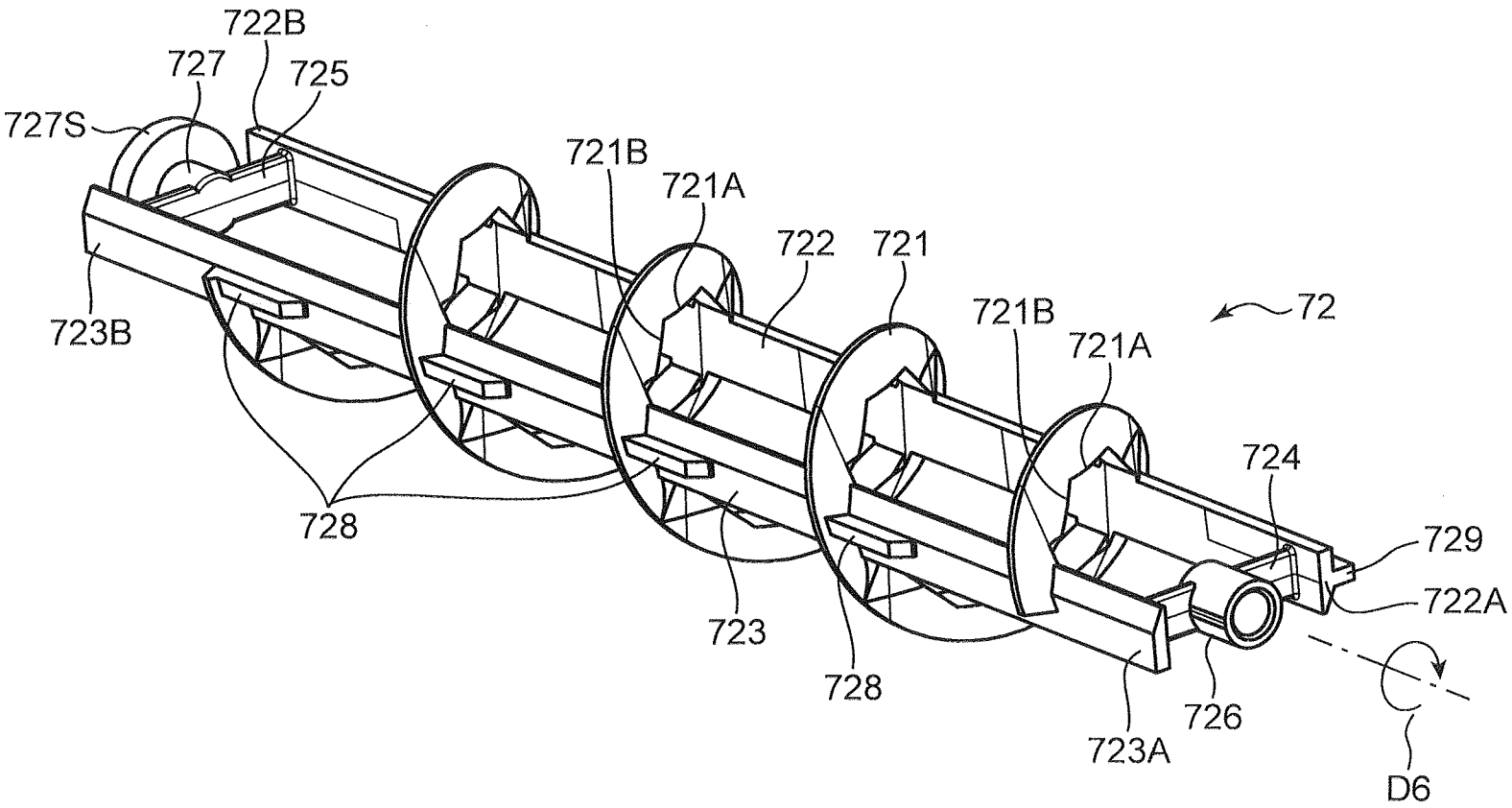
FIG. 6 is a perspective view of the conveyor screw according to the embodiment of the present disclosure.
Figure 7:
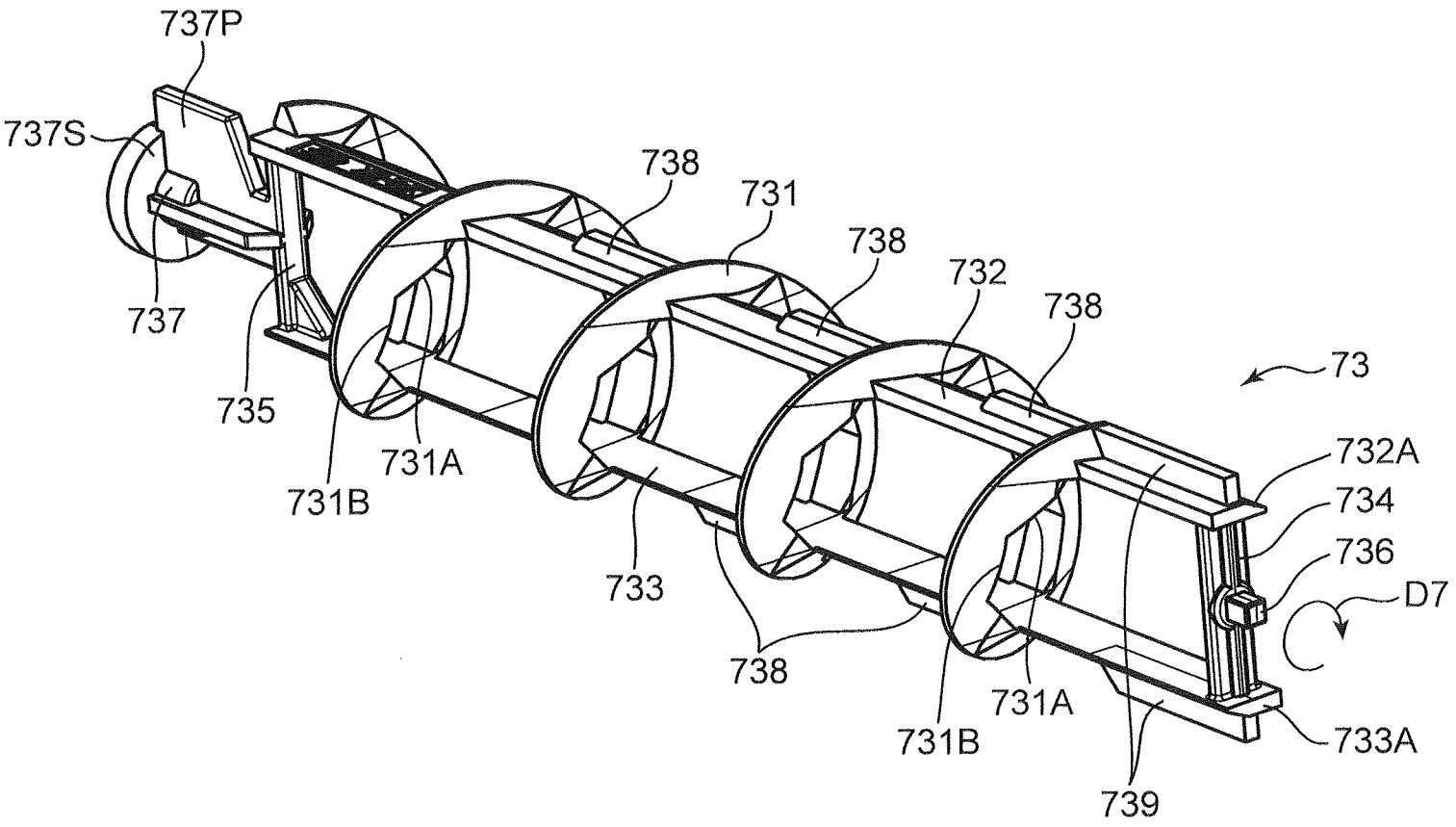
FIG. 7 is a perspective view of the conveyor screw according to the embodiment of the present disclosure.

Next, the first and second conveyor screws 72, 73 arranged in the developing device 70 according to this embodiment are described in detail with reference to FIGS. 4 to 7 in addition to FIGS. 3A and 3B. FIG. 4 is a front view of the first conveyor screw 72, and FIG. 5 is a plan view of the second conveyor screw 73. FIGS. 6 and 7 are respectively perspective views of the first and second conveyor screws 72, 73. In FIG. 4, the first conveyor screw 72 is rotated in a direction of an arrow D41 and the developer is conveyed in a direction of an arrow D42. Similarly, in FIG. 5, the second conveyor screw 73 is rotated in a direction of an arrow D51 and the developer is conveyed in a direction of an arrow D52. Further, in FIGS. 6 and 7, the first and second conveyor screws 72, 73 are respectively rotated in directions of arrows D6, D7.

<Regarding First Conveyor Screw 72>

The first conveyor screw 72 (agitating-side conveying member) is described with reference to FIGS. 3A, 3B, 4 and 6. As described above, the first conveyor screw 72 is arranged in the first conveying portion 74*a*. The first conveyor screw 72 includes an 11th shaft portion 726, a 12th shaft portion 727, an 11th rib 722 (second rib member), a 12th rib 723 (second rib member), an 11th connecting piece 724, a 12th connecting piece 725, a first screw 721 (agitating-side spiral member) and a first seal 727S.

The 11th shaft 726 and the 12th shaft portion 727 are respectively rotatably supported on the second and first wall portions 70C and 70B. The 11th and 12th shaft portions 726, 727 are shaft parts which serve as a rotary shaft of the first conveyor screw 72. The 11th and 12th shaft portions 726, 727 are respectively rotatably support the first conveyor screw 72 on one end side and the other end side (opposite end parts) of the first conveyor screw 72 in the axial direction. The 11th shaft portion 726 includes a cylindrical bearing portion inside. An unillustrated projection projecting from the second wall portion 70C of the developer housing 70A toward the first conveying portion 74*a* is inserted into the bearing portion of the 11th shaft portion 726. Similarly, the 12th shaft portion 727 includes a cylindrical bearing portion inside. An unillustrated projection projecting from the first wall portion 70B of the developer housing 70A toward the first conveying portion 74*a* is inserted into the bearing portion of the 12th shaft portion 727. As a result, the first conveyor screw 72 is rotatably supported in the developer housing 70A. At this time, a virtual rotary shaft of the first conveyor screw 72 is formed between the 11th and 12th shaft portions 726, 727 in the axial direction of the first conveyor screw 72.

The 11th rib 722 and the 12th rib 723 are plate-like members respectively extending from one end side to the other end side of the first conveyor screw 72. Further, the 11th and 12th ribs 722, 723 are plate-like members having a predetermined width in a circumferential direction of the first conveyor screw 72. The 11th and 12th ribs 722, 723 are arranged in parallel to face each other with the rotary shaft of the first conveyor screw 72 as a center. In other words, the 11th and 12th ribs 722, 723 are arranged at an interval of 180° in the circumferential direction of the first conveyor screw 72. The 11th and 12th ribs 722, 723 extend from the vicinity of the 11th shaft portion 726 to the vicinity of the 12th shaft portion 727 in the axial direction of the first conveyor screw 72. The 11th and 12th ribs 722, 723 have a function of supporting the first screw 721 to be described later and agitating the developer in the first conveying portion 74*a*.

The 11th connecting piece 724 is arranged to face the second wall portion 70C and connects end parts of the 11th and 12th ribs 722, 723 at one end side in a radial direction of the first conveyor screw 72. Further, the 11th shaft portion 726 described above projects axially outward of the first conveyor screw 72 from a central part of the 11th connecting piece 724. In other words, the 11th connecting piece 724 connects the end parts of the 11th and 12th ribs 722, 723 in the conveying direction to the 11th shaft portion 726. Similarly, the 12th connecting piece 725 connects end parts of the 11th and 12th ribs 722, 723 at the other end side in the radial direction of the first conveyor screw 72. Further, the 12th shaft portion 727 described above projects axially outward of the first conveyor screw 72 from a central part of the 12th connecting piece 725.

The 11th rib 722 includes an 11th leading end portion 722A at the outer side of the 11th connecting piece 724 in the axial direction of the first conveyor screw 72. The 11th leading end portion 722A is formed since one end of the 11th rib 722 projects more axially outward (toward the second wall portion 70C) than the 11th connecting piece 724. Further, the 11th rib 722 includes an 11th rear end portion 722B at the outer side of the 12th connecting piece 725 in the axial direction of the first conveyor screw 72. The 11th rear end portion 722B is formed since the other end of the 11th rib 722 projects more axially outward (toward the first wall portion 70B) than the 12th connecting piece 725.

Similarly, the 12th rib 723 includes a 12th leading end portion 723A at the outer side of the 11th connecting piece 724 in the axial direction of the first conveyor screw 72. The 12th leading end portion 723A is formed since one end of the 12th rib 723 projects more axially outward than the 11th connecting piece 724. Further, the 12th rib 723 includes a 12th rear end portion 723B at the outer side of the 12th connecting piece 725 in the axial direction of the first conveyor screw 72. The 12th rear end portion 723B is formed since the other end of the 12th rib 723 projects more axially outward than the 12th connecting piece 725.

The first screw 721 (agitating-side spiral member) spirally extends in the developer conveying direction and forms the outer peripheral edge of the first conveyor screw 72. Specifically, the first screw 721 is formed by connecting spiral pieces, each forming one spiral turn, in the conveying direction. The first screw 721 includes a hollow interior formed by the connected spiral pieces. In other words, the first screw 721 is a spiral conveying member which is arranged between the 11th and 12th shaft portions 726, 727 with a gap formed in the radial direction between the first screw 721 and the virtual rotary shaft of the first conveyor screw 72 and includes the hollow interior. The 11th and 12th ribs 722, 723 bridge adjacent ones of the spiral pieces of the first screw 721. In other words, the first screw 721, the 11th rib 722 and the 12th rib 723 are so configured that the first screw 721 is composed of a plurality of the spiral pieces and these plurality of spiral pieces are united by the pair of 11th and 12th ribs 722, 723, with the result that the spiral first screw 721 having a hollow part at an axial center side is formed. Note that, as shown in FIGS. 3B, 4 and 6, areas where the first screw 721 is not arranged are present at opposite axial end parts of the 11th and 12th ribs 722, 723.

With reference to FIG. 4, a spiral part of the first screw 721 is composed of a ridge part 721R forming the outer peripheral edge of the first screw 721 having a maximum diameter and a pair of inclined surfaces 721P, 721Q extending from the ridge part 721R to respectively face one and the other axial end sides in a cross-section including the rotary shaft of the first conveyor screw 72.

Further, a plurality of planar portions connected in the circumferential direction of the first conveyor screw 72 are arranged on the inner side of the spiral part of the first screw 721. Specifically, on the inner side (underside) of the ridge part 721R of the first screw 721, the pair of inclined surfaces 721P, 721Q are connected by the planar portions. The planar portions are arranged on the inner side of the ridge part 721R while being bent at predetermined angles along the axial direction of the first conveyor screw 72.

In other words, with reference to FIG. 3A, a first inner wall portion 721S (also called inner wall portion) is arranged on an inner peripheral part of the first screw 721. The first inner wall portion 721S faces the hollow interior of the first screw 721 and is formed such that a plurality of planar portions are connected at predetermined angles in the circumferential direction. The first inner wall portion 721S is composed of an 11th inner wall surface 721A, a 12th inner wall surface 721B, a 13th inner wall surface 721C, a 14th inner wall surface 721D, a 15th inner wall surface 721E, a 16th inner wall surface 721F, a 17th inner wall surface 721G and an 18th inner wall surface 721H (all are planar portions). These form a substantially regular octagonal shape in a cross-section intersecting with the axial direction of the first conveyor screw 72 as shown in FIG. 3A. Specifically, these plurality of inner wall surfaces are connected at a plurality of connecting portions in the circumferential direction. The plurality of connecting portions connect the plurality of inner wall surfaces at the same angle (constant angle). Note that the 13th and 17th inner wall surfaces 721C, 721G respectively correspond to inner surface portions of the 12th and 11th ribs 723, 722. Specifically, the inner surface portions of the plate-like 12th and 11th ribs 723, 722 facing the hollow interior form some of the plurality of inner wall surfaces of the first screw 721.

The first seal 727S is a circular ring-shaped elastic member arranged radially outward of the 12th shaft portion 727. The first seal 727S is held in contact with an inner wall portion of the first wall portion 70B of the developer housing 70A in a state where the first screw 721 is mounted in the developer housing 70A. As a result, the first seal 727S suppresses the aggregation of the developer between the 12th shaft portion 727 and the inner wall portion of the first wall portion 70B according to the rotation of the first conveyor screw 72.

Further, the first conveyor screw 72 includes 11th projections 728 (second projection member) and a 12th projection 729.

The 11th projections 728 are wall portions radially projecting from radially outer wall parts of the 11th and 12th ribs 722, 723. The 11th projections 728 project up to a height slightly inwardly of the outer peripheral edge of the first screw 721 in the radial direction of the first conveyor screw 72. Further, a base end part of the 11th projection 728 is connected to one blade part of the first screw 721 in the axial direction of the first conveyor screw 72. The other end part of the 11th projection 728 is arranged between another blade part arranged adjacent to the one blade part of the first screw 721 in the axial direction and the one blade part. In other words, the first projection 728 extends from the one blade part of the first screw 721 in a direction (arrow Da of FIG. 3B, arrow D42 of FIG. 4) in which the first conveyor screw 72 conveys the developer in the first conveying portion 74*a*. A leading end part of the 11th projection 728 in its extending direction is arranged substantially in a central part between the above two blade parts without being connected to the other blade part arranged adjacent to the one blade part.

Similarly, the 12th projection 729 (FIG. 6) is a wall portion radially projecting from a radially outer wall part of the 11th rib 722. The 12th projection 729 is arranged to have a predetermined length in the axial direction on an end part of the 11th rib 722 at the side of the 11th shaft portion 726. An axial outer end part of the 12th projection 729 is arranged to be flush with that of the 11th leading end portion 722A.

<Regarding Second Conveyor Screw 73>

Next, the second conveyor screw 73 (supply-side conveying member) is described with reference to FIGS. 3, 5 and 7. Note that since the shape of the second conveyor screw 73 is similar to that of the first conveyor screw 72, parts common to the first conveyor screw 72 are not described and points of difference from the first conveyor screw 72 are mainly described in detail. As described above, the second conveyor screw 73 is arranged in the second conveying portion 74*b*. The second conveyor screw 73 includes a $21^{st}$ shaft portion 736, a $22^{nd}$ shaft portion 737, a $21^{st}$ rib 732 (first rib member), a $22^{nd}$ rib 733 (first rib member), a $21^{st}$ connecting piece 734, a $22^{nd}$ connecting piece 735, a paddle 737P, a second screw 731 (supply-side spiral member) and a second seal 737S.

The 21st and 22nd shaft portions 736, 737 correspond to the 11th and 12th shaft portions 726, 727 of the first conveyor screw 72. The second conveyor screw 73 is rotatably supported in the developer housing 70A by the 21st and 22nd shaft portions 736, 737. At this time, a virtual rotary shaft of the second conveyor screw 73 is formed between the 21st and 22nd shaft portions 736, 737 in the axial direction of the second conveyor screw 73.

The 21st and 22nd ribs 732, 733 correspond to the 11th and 12th ribs 722, 723 of the first conveyor screw 72. The 21st and 22nd connecting pieces 734, 735 correspond to the 11th and 12th connecting pieces 724, 725 of the first conveyor screw 72. Note that, as shown in FIG. 5, the 22nd connecting piece 735 is arranged axially inwardly of and at a predetermined distance from the 22nd shaft portion 737. The 21st and 22nd ribs 732, 733 also extend up to an area axially inwardly of and at a predetermined distance from the 22nd shaft portion 737 and are connected to each other by the 22nd connecting piece 735.

The 21st rib 732 includes a 21st leading end portion 732A at the outer side of the 21st connecting piece 734 in the axial direction of the first conveyor screw 73. The 21st leading end portion 732A is formed since one end of the 21st rib 732 projects more axially outward (toward the second wall portion 70C) than the 21st connecting piece 734. Similarly, the 22nd rib 733 includes a 22nd leading end portion 733A at the outer side of the 21st connecting piece 734 in the axial direction of the first conveyor screw 73. The 22nd leading end portion 733A is formed since one end of the 22nd rib 733 projects more axially outward than the 21st connecting piece 734. Note that the 21st and 22nd ribs 732, 733 of the second conveyor screw 73 extend until they intersect with the 22nd connecting piece 735 and do not extend more axially outward than the 22nd connecting piece 735 unlike the first conveyor screw 72.

The paddle 737P is a plate-like member arranged axially outwardly of the 22nd connecting piece 735. The paddle 737P radially extends from the rotary shaft of the second conveyor screw 73. In this embodiment, the paddle 737P projects in a direction toward a position where the 21st rib 732 is arranged in the circumferential direction of the second conveyor screw 73. The 22nd shaft portion 737 is connected to an axially outer part of the paddle 737P. Further, the second seal 737S to be described later is connected to an axially outer end edge of the paddle 737P. The paddle 737P has a function of transferring the developer from the second conveying portion 74*b* to the first conveying portion 74*a* via the first communicating portion 704.

The second screw 731 corresponds to the first screw 721 of the first conveyor screw 72. The shape of the second screw 731 in a cross-section including the rotary axis of the second conveyor screw 73 is also similar to the first conveyor screw 72.

Particularly, with reference to FIG. 3A, a second inner wall portion 731S is arranged on an inner peripheral part of the second screw 731. The second inner wall portion 731S is formed such that a plurality of planar portions are connected at predetermined angles. The second inner wall portion 731S is composed of a 21st inner wall surface 731A, a 22nd inner wall surface 731B, a 23rd inner wall surface 731C, a 24th inner wall surface 731D, a 25th inner wall surface 731E, a 26th inner wall surface 731F, a 27th inner wall surface 731G and a 28th inner wall surface 731H. These form a substantially regular octagonal shape in a cross-section intersecting with the axial direction of the second conveyor screw 73 as shown in FIG. 3A. Note that the 24th and 28th inner wall surfaces 731D, 731H respectively correspond to inner surface portions of the plate-like 22nd and 21st ribs 733, 732.

The second seal 737S is a circular ring-shaped elastic member arranged radially outward of the 22nd shaft portion 737. The second seal 737S is held in contact with an inner wall portion of the first wall portion 70B of the developer housing 70A in a state where the second conveyor screw 73 is mounted in the developer housing 70A. As a result, the second seal 737S suppresses the aggregation of the developer between the 22nd shaft portion 737 and the inner wall portion of the first wall portion 70B according to the rotation of the second conveyor screw 73.

Further, the second screw 731 includes 21st projections 738 (first projection member) and 22nd projections 739. The 21st projections 738 correspond to the 11th projections 728 of the first conveyor screw 72. The 21st projections 738 are wall portions radially projecting from radially outer wall parts of the 21st and 22nd ribs 732, 733. The 21st projections 738 project up to a height slightly inwardly of the outer peripheral edge of the second screw 731 in the radial direction of the second conveyor screw 73. Further, a base end part of the 21st projection 738 is connected to one blade part of the second screw 731 in the axial direction of the second conveyor screw 73. The other end part of the 21st projection 738 is arranged between another blade part arranged adjacent to the one blade part of the second screw 731 and the one blade part. In other words, the first projection 738 extends from an area where the second screw 731 and the 21st rib 732 or the 22nd rib 733 intersect (first area) in a direction (arrow Db of FIG. 3B, arrow D52 of FIG. 5) in which the second conveyor screw 73 conveys the developer in the second conveying portion 74*b* along an outer wall portion of the 21st rib 732 or the 22nd rib 733. At this time, a leading end part of the 21st projection 738 in its extending direction is arranged substantially in a central part between the above two blade parts without being connected to the other blade part arranged adjacent to the one blade part.

On the other hand, the 22nd projections 739 are a pair of wall portions radially projecting from radially outer wall parts of the 21st and 22nd ribs 732, 733. The 22nd projections 739 are arranged to have a predetermined length in the axial direction on end parts of the 21st and 22nd ribs 732, 733 at the side of the 21st shaft portion 736. Note that axial outer end parts of the 21st and 22nd leading end portions 732A, 733A project slightly more axially outward than axial outer end parts of the 22nd projections 739. Further, axial lengths of the 22nd projections 739 are set to be longer than those of the 21st projections 738.

<Regarding Functions and Effects of First and Second Inner Wall Portions 721S, 731S>

Next, functions and effects of the first inner wall portion 721S of the first conveyor screw 72 according to this embodiment are described. Note that the following functions and effects are the same as with the second inner wall portion 731S of the second conveyor screw 73.

As described above, the first screw 721 of the first conveyor screw 72 is a hollow spiral conveying member. In other words, the first conveyor screw 72 has no shaft part between the 11th shaft portion 726 and the 12th shaft portion 727. This prevents an increase in the viscosity of the developer and the adhesion of the developer to the shaft part when the developer in the developer storage 74 is deteriorated or when an environment surrounding the developing device 70 reaches a high temperature. If developer with increased viscosity adheres to a shaft part, the conveying performance of a conveyor screw including the shaft part is reduced. The first conveyor screw 72 according to this embodiment can solve such a problem by having the above hollow shape.

On the other hand, if the fluidity of the developer decreases due to a high-temperature environment or the deterioration of the developer, the developer is more likely to stay in the hollow interior of the first screw 721. As a result, the developer may aggregate while having a cylindrical shape with a maximum outer diameter at the inner wall part of the first screw 721. Such aggregation is notable in the case of one-component developer. This is because carrier acts to suppress the aggregation of toner in the case of two-component developer composed of the toner and the carrier. Further, if the inner wall of the first screw 721 forms a curved surface continuous in the circumferential direction, the developer arranged at the inner side of this inner wall is more likely to cylindrically aggregate. On the other hand, as described above, the first conveyor screw 72 according to this embodiment includes the first inner wall portion 721S. Specifically, the first inner wall portion 721S is formed by connecting the plurality of planar portions at the predetermined angles. As shown in FIG. 3A, the first inner wall portion 721S has a substantially regular octagonal shape in the cross-section intersecting with the axial direction of the first conveyor screw 72.

According to such a first inner wall portion 721S, a pressure whose magnitude cyclically varies is applied to the developer being conveyed inside the first screw 721. Specifically, when the inner wall of the first screw 721 is viewed from the virtual rotary shaft part of the first conveyor screw 72 in the above cross-section, a trace of the inner wall of the first screw 721 changes between surface parts represented by the 11th inner wall surface 721A and intersection parts of the plurality of surfaces according to the rotation of the first screw 721. A cross-sectional shape of the first inner wall portion 721S is not a circular shape having a uniform inner diameter, but an irregular shape having a varying diameter. Due to the irregular shape, an aggregate of the developer arranged in the hollow interior of the first screw 721 tends to collapse if the first screw 721 is rotated. As a result, even if the fluidity of the developer decreases, the first inner wall portion 721S has a function of collapsing an aggregate of the developer inside the first screw 721. Further, a pressure whose magnitude cyclically varies is applied to the developer arranged inside the first screw 721. As a result, even if the fluidity of the developer decreases, the first inner wall portion 721S has the function of collapsing an aggregate of the developer inside the first screw 721. Thus, as described above, the cylindrical aggregation of the developer inside the first screw 721 is suppressed. The second inner wall portion 731S of the second conveyor screw 73 also achieves similar functions and effects. Note that cross-sectional shapes of the first and second inner wall portions 721S, 731S are not limited to substantially regular octagonal shapes. Functions and effects similar to the above are achieved by connecting a plurality of planar parts at predetermined angles in the circumferential direction on the inner wall part of the first screw 721 or the second screw 731.

<Regarding Functions and Effects of 11th and 12th Leading End Portions 722A, 723A>

Figure 8:
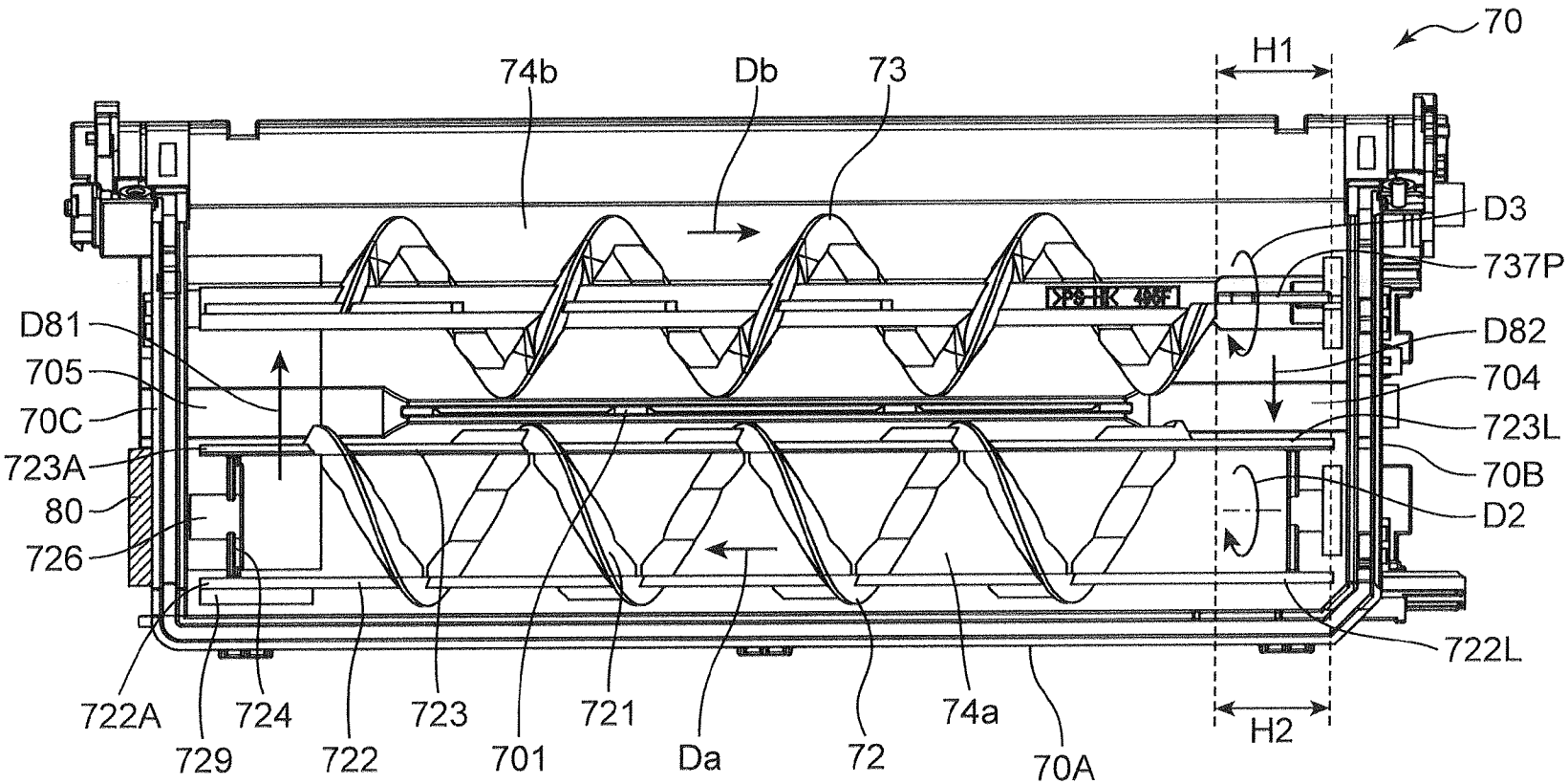
FIG. 8 is a plan view showing the internal structure of the developing device according to the embodiment of the present disclosure.

Next, functions and effects of the 11th and 12th leading end portions 722A, 723A are described with reference to FIGS. 3B and 8. Note that effects similar to the following ones are also achieved by the 11th rear end portion 722B, the 12th rear end portion 723B (FIG. 6), the 21st leading end portion 732A and the 22nd leading end portion 733A (FIG. 7). Similarly to FIG. 3B, FIG. 8 is a plan view of the developer housing 70A of the developing device 70 when viewed from above. As described above, the 11th and 12th leading end portions 722A, 723A of the first conveyor screw 72 are respectively formed since one ends of the 11th and 12th ribs 722, 723 project more axially outward than the 11th connecting piece 724. The 11th and 12th leading end portions 722A, 723A are arranged to face the second wall portion 70C of the developer housing 70A.

The developer conveyed in a direction of an arrow Da of FIG. 8 by the first conveyor screw 72 in the first conveying portion 74*a* is moved toward the second conveying portion 74*b* at the second communicating portion 705. At this time, since the first conveyor screw 72 is rotated in a direction D2 of FIG. 8, the developer is mostly moved in the direction of the arrow Da along the partition plate 701 in the first conveying portion 74*a*. However, if the developer in the developer storage 74 is deteriorated and the fluidity thereof decreases, the developer located between the 11th connecting piece 724 and the second wall portion 70C is less likely to join the developer moved along the partition plate 701 as described above. As a result, the developer stays between the 11th connecting piece 724 and the second wall portion 70C. If the developer stays at a downstream end part of the first conveying portion 74*a* in this way, the transfer of the developer from the first conveying portion 74*a* to the second conveying portion 74*b* is deteriorated and a distribution of the developer in the developer storage 74 becomes uneven. Further, chargeability may vary in the developer in the developer storage 74.

Even in such a case, in this embodiment, the 11th and 12th leading end portions 722A, 723A projecting axially outward from the 11th connecting piece 724 actively agitate the developer staying near the second wall portion 70C as the first conveyor screw 72 rotates. Note that if the 11th connecting piece 724 connects axial tips of the 11th and 12th leading end portions 722A, 723A (if the 11th and 12th leading end portions 722A, 723A do not project axially outward), it strongly presses the developer staying between the 11th connecting piece 724 and the second wall portion 70C against the second wall portion 70C. In this case, the developer staying between the 11th connecting piece 724 and the second wall portion 70C is more likely to aggregate. Thus, the 11th and 12th leading end portions 722A, 723A are so arranged as to project axially outward from the 11th connecting piece 724, whereby the developer is effectively agitated. Since the fluidity of the developer being agitated increases, the developer is moved from the second communicating portion 705 to the second conveying portion 74*b* (arrow D81 of FIG. 8). At this time, the movement of the developer from the first conveying portion 74*a* to the second conveying portion 74*b* is promoted by the rotation of the 12th projection 729 of the first conveyor screw 72.

Further, in this embodiment, the developing device 70 includes a toner sensor 80 in an area of the second wall portion 70C facing the first conveying portion 74*a* as shown in FIG. 8. The toner sensor 80 is an eddy-current sensor. The toner sensor 80 is arranged on the second wall portion 70C to face the 11th and 12th leading end portions 722A, 723A at a downstream side of the first conveyor screw 72 in the conveying direction and detects the amount of the developer in the developer housing 70A. Specifically, the toner sensor 80 outputs a current value corresponding to a pressure applied to the second wall portion 70C by the developer (toner) distributed at the inner side of the second wall portion 70C in the first conveying portion 74*a*. As a result, the amount of the developer stored in the developer storage 74 of the developer housing 70A is detected by the toner sensor 80. As described above, when the developer stays between the 11th connecting piece 724 and the second wall portion 70C, a decrease in the amount of the developer may not be detected by the toner sensor 80 even if the amount of the developer in the developer storage 74 actually decreases. In this embodiment, as described above, the developer arranged between the 11th connecting piece 724 and the second wall portion 70C is preferably agitated by the 11th and 12th leading end portions 722A, 723A. Thus, the stay of the developer is suppressed and the amount of the developer in the developer storage 74 is accurately detected by the toner sensor 80. At this time, if a paddle member such as the paddle 737P is arranged to face the toner sensor 80, an output of the toner sensor 80 may largely vary according to a rotation period of the paddle member. Further, if developer adheres to a paddle surface of the paddle member, the detection of the toner sensor 80 is not stably realized. Thus, it is particularly preferable to adopt the shapes of the 11th and 12th leading end portions 722A, 723A in an area where the toner sensor 80 is facing. Note that a developer agitating effect similar to the above is achieved also by the 11th and 12th rear end portions 722B, 723B arranged to face the first wall portion 70B and further by the 21st and 22nd leading end portions 732A, 733A arranged to face the second wall portion 70C at the side of the second conveying portion 74*b*.

Note that, in this embodiment, the toner sensor 80 is arranged on the second wall portion 70C as described above. Thus, as described above, the projection projects from the inner wall portion of the second wall portion 70C and the 11th shaft portion 726 is fitted to rotatably support the first conveyor screw 72. Therefore, a bearing part of the first conveyor screw 72 does not project on an outer wall portion of the second wall portion 70C, wherefore the arrangement of the toner sensor 80 is not hindered. Further, since the 11th and 12th leading end portions 722A, 723A project at opposite sides of the 11th shaft portion 726 in the radial direction of the first conveyor screw 72, the stay of the developer is suppressed around the above projection. This prevents the developer from being clogged in the bearing part of the 11th shaft portion 726 and the rotation of the first conveyor screw 72 is preferably maintained.

<Regarding Functions and Effects of Downstream Receiving Portion H2 (11th Screw Receiving Portion 722L, 12th Screw Receiving Portion 723L) and Upstream Receiving Portion K2 (21st Screw Receiving Portion 732L, 22nd Screw Receiving Portion 733L)>

Figure 9B:
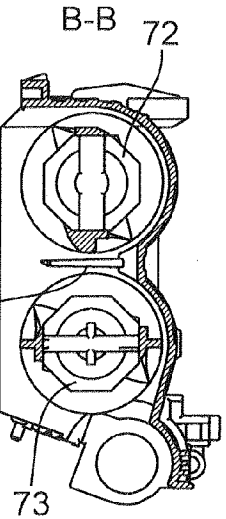
FIG. 9A is a plan view and FIGS. 9B and 9C are sectional views showing the internal structure of the developing device according to the embodiment of the present disclosure, FIG. 10A a is plan view
Figure 9A:
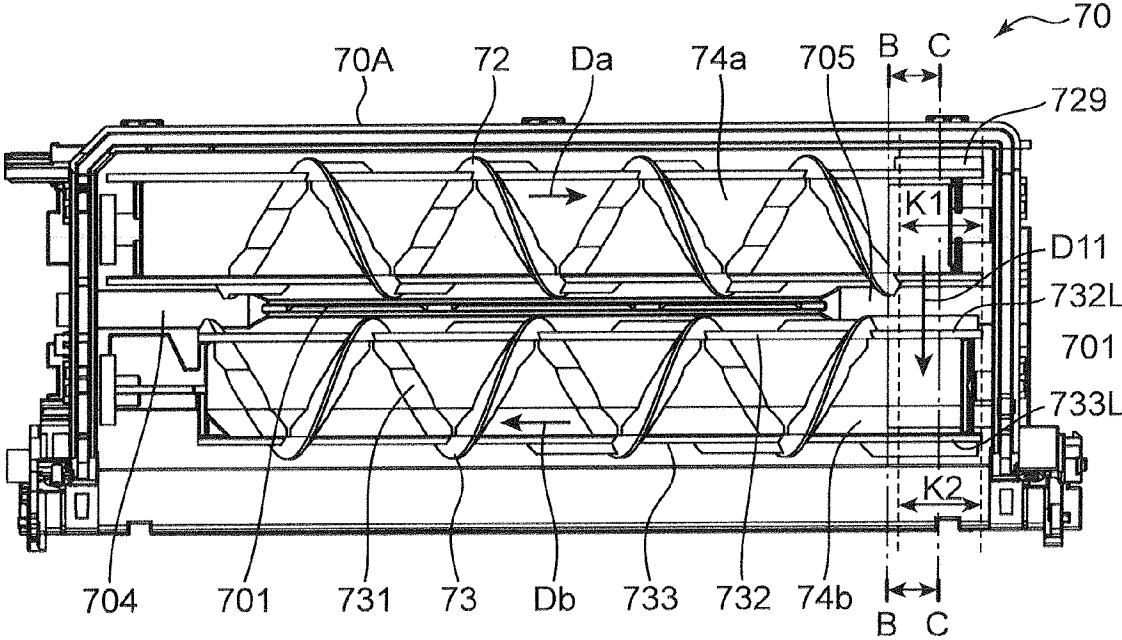
Figure 9C:
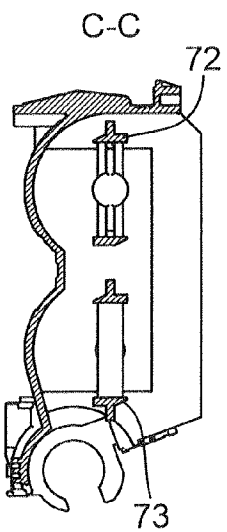

Next, a downstream receiving portion H2 and an upstream receiving portion K2 of the developing device 70 are described with reference to FIGS. 8, 9A, 9B and 9C. Similarly to FIG. 8, FIG. 9A is a plan view of the developing device 70. Note that a state shown in FIG. 9A is a vertically inverted state of a state shown in FIG. 8. Further, FIGS. 9B and 9C are respectively sectional views at positions B-B and C-C of FIG. 9A. In a state where the first and second conveyor screws 72, 73 are mounted in the developer housing 70A of the developing device 70, the downstream receiving portion H2 is arranged on an upstream end part of the first conveyor screw 72 in the conveying direction and an upstream transferring portion K1 is arranged on a downstream end part of the first conveyor screw 72 in the conveying direction. Further, the upstream receiving portion K2 is arranged on an upstream end part of the second conveyor screw 73 in the conveying direction and a downstream transferring portion H1 is arranged on a downstream end part of the second conveyor screw 73 in the conveying direction (FIG. 9A). With reference to FIG. 8, the downstream transferring portion H1 means an area where the paddle 737P is arranged in the axial direction of the second conveyor screw 73. Further, the downstream receiving portion H2 corresponds to an area of the first conveyor screw 72 facing the paddle 737P (downstream transferring portion H1) of the second conveyor screw 73 in a direction perpendicular to the axial direction of the first conveyor screw 72. Parts of the 11th and 12th ribs 722, 723 corresponding to the downstream receiving portion H2 are respectively defined as an 11th screw receiving portion 722L and a 12th screw receiving portion 723L. The spiral part of the first screw 721 is not arranged in the 11th and 12th screw receiving portions 722L, 723L. Specifically, an upstream end part of the first screw 721 in the conveying direction is arranged downstream of the downstream receiving portion H2 in the conveying direction. As a result, the developer flowed into the first communicating portion 704 from the downstream transferring portion H1 by the paddle 737P of the second conveyor screw 73 is smoothly transferred to the downstream receiving portion H2 (arrow D82 of FIG. 8). In other words, if the spiral part of the first screw 721 is arranged in the downstream receiving portion H2 of the first conveyor screw 72, the spiral part diffuses the developer in a rotation radial direction of the first conveyor screw 72. Specifically, the developer flowed in from the second conveying portion 74*b* via the first communicating portion 704 is pushed back toward the second conveying portion 74*b* by the spiral part. Thus, the generation of a reverse flow of the developer as described above is suppressed by the downstream receiving portion H2 of the first conveyor screw 72 and the transfer of the developer from the second conveying portion 74*b* to the first conveying portion 74*a* is preferably realized. Further, since the paddle 737P has a paddle shape in this embodiment, the developer is accurately transferred from the second conveying portion 74*b* to the first conveying portion 74*a*. Further, the transferred developer is moved toward a part of a rotational axial center of the first conveyor screw 72 by the rotation of the 11th and 12th screw receiving portions 722L, 723L of the 11th and 12th ribs 722, 723 arranged in the downstream receiving portion H2. Thus, the continuous transfer of the developer is preferably realized without the developer being stayed near the first communicating portion 704.

Similarly, with reference to FIG. 9A, the upstream transferring portion K1 means an area of the first conveyor screw 72 where the 12th projection 729 is arranged in the axial direction. Further, the upstream receiving portion K2 corresponds to an area of the second conveyor screw 73 facing the 12th projection 729 (upstream transferring portion K1) of the first conveyor screw 72 in a direction perpendicular to the axial direction of the second conveyor screw 73. Parts of the 21st and 22nd ribs 732, 733 corresponding to the upstream receiving portion K2 are respectively defined as a 21st screw receiving portion 732L and a 22nd screw receiving portion 733L. The spiral part of the second screw 731 is not arranged in the 21st and 22nd screw receiving portions 732L, 733L. Specifically, an upstream end part of the second screw 731 in the conveying direction is arranged downstream of the upstream receiving portion K2 in the conveying direction. As a result, the developer flowed into the second communicating portion 705 from the downstream end part of the first conveying portion 74*a* by the 12th projection 729 of the first conveyor screw 72 is smoothly transferred to the upstream end part of the second conveying portion 74*b* (arrow D11 of FIG. 9A). In other words, if the spiral part of the second screw 731 is arranged in the upstream receiving portion K2 of the second conveyor screw 73, the spiral part diffuses the developer in a rotation radial direction of the second conveyor screw 73. Specifically, the developer flowed in from the first conveying portion 74*a* via the second communicating portion 705 is pushed back toward the first conveying portion 74*a* by the spiral part. Thus, the generation of a reverse flow of the developer as described above is suppressed by the upstream receiving portion K2 of the second conveyor screw 73 and the transfer of the developer from the first conveying portion 74*a* to the second conveying portion 74*b* is preferably realized.

Further, in this embodiment, the 22nd projections 739 (FIGS. 5, 7) are arranged on the 21st and 22nd ribs 732, 733 of the second conveyor screw 73 in the upstream receiving portion K2. The 22nd projections 739 are set to be longer in the axial direction of the second conveyor screw 73 than the 21st projections 738. By arranging the 22nd projections 739 extending long in the axial direction in the upstream receiving portion K2 in this way, the developer transferred from the first conveying portion 74*a* is quickly moved to an axial central part of the second conveyor screw 73. As a result, the stay of the developer in the second communicating portion 705 is suppressed and the transfer of the developer from the first conveying portion 74*a* to the second conveying portion 74*b* is preferably realized.

Furthermore, in this embodiment, the areas where the first and second screws 721, 731 are not arranged are present on the axial outer parts of the first and second conveyor screws 72, 73 as described above, in other words, the downstream receiving portion H2 and the upstream receiving portion K2 are provided, whereby the cylindrical developer aggregation as described above is further suppressed. Specifically, by not arranging the first and second screws 721, 731 on the axial end parts of the first and second conveyor screws 72, 73, the hollow parts of the first and second conveyor screws 72, 73 are open on the end parts. As a result, the developer arranged in the hollow interiors of the first and second screws 721, 731 easily escapes to axial outer sides. As a result, the cylindrical aggregation of the developer is suppressed while the transfer of the developer between the first and second conveying portions 74*a*, 74*b* is preferably maintained.

<Regarding Functions and Effects of 11th Projections 728 and 21st Projections 738>

Figures 10A, 10B:
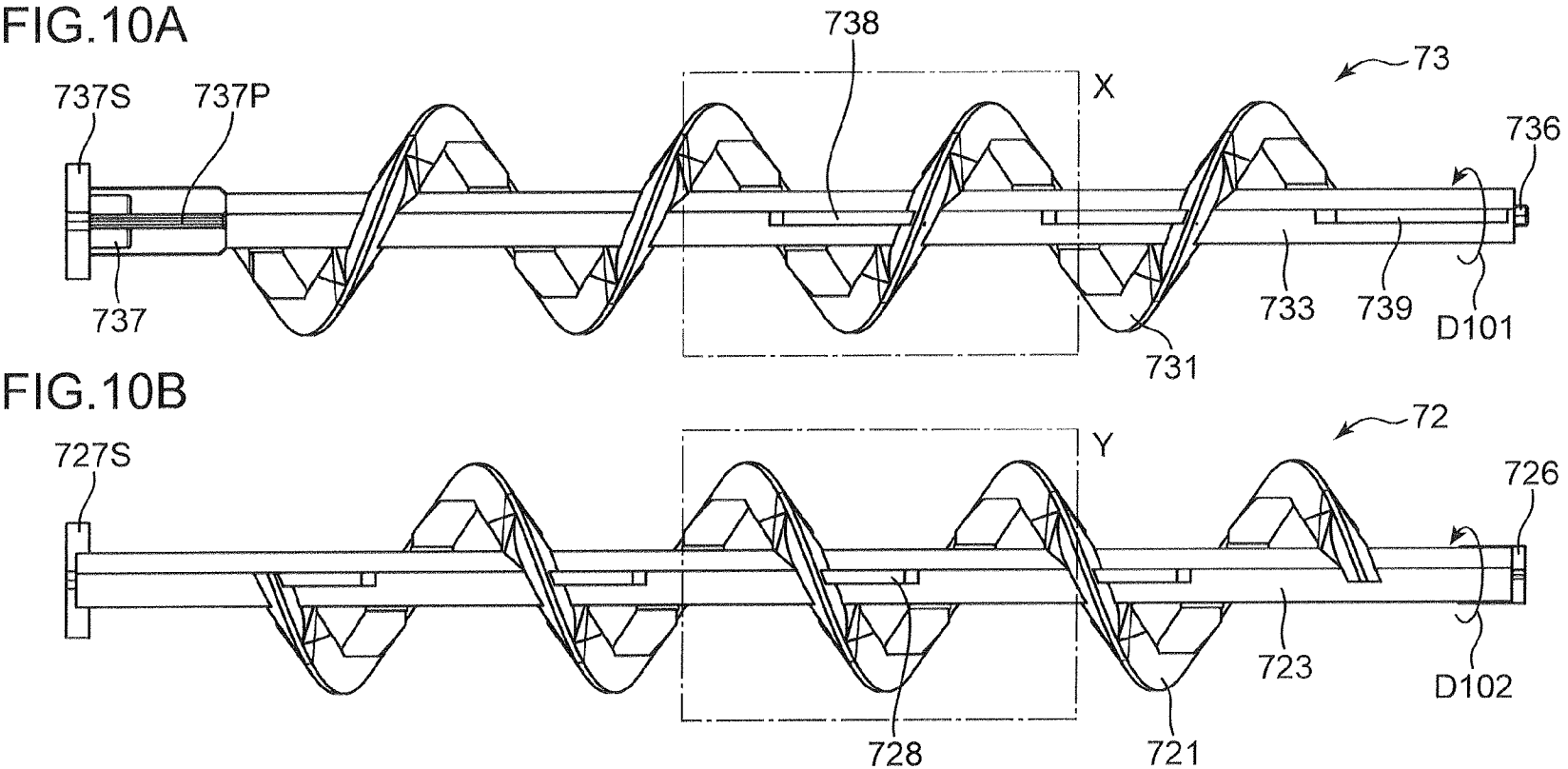
FIG. 10B is a front view of the conveyor screws according to the embodiment of the present disclosure.
Figure 11A:
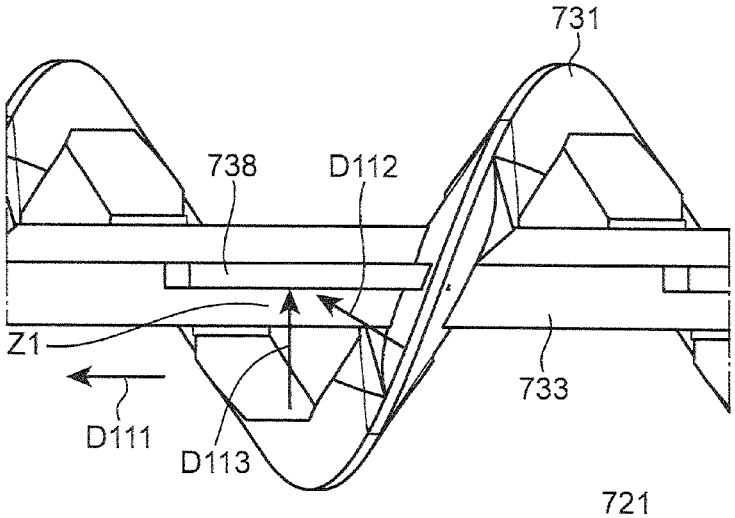
FIGS. 11A and 11B are enlarged views of the conveyor screws according to the embodiment of the present disclosure.
Figure 11B:
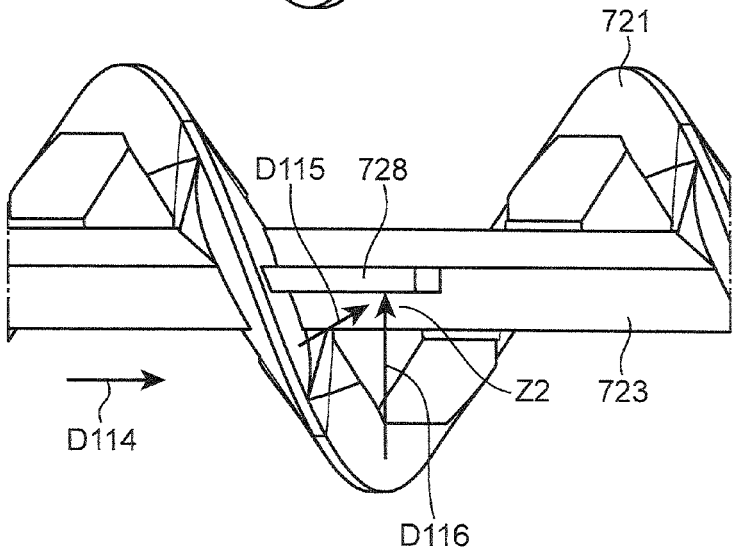
Figure 12:
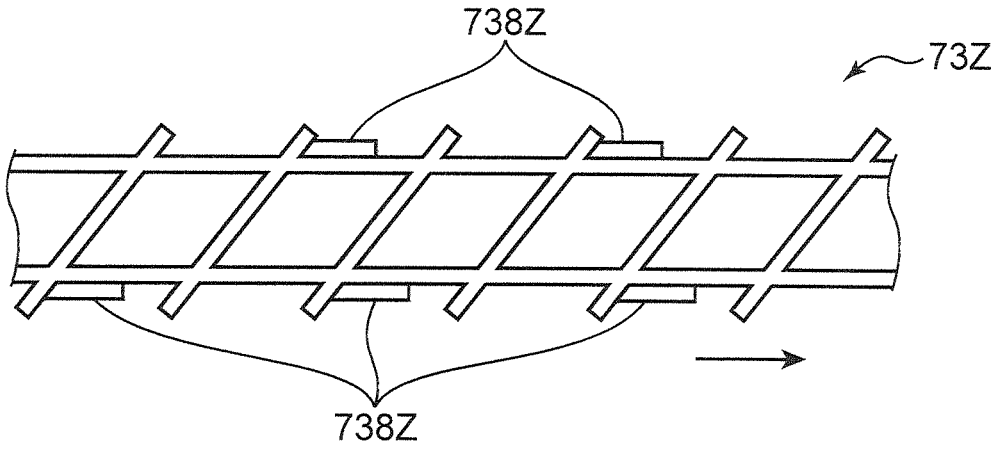
FIG. 12 is a diagram of a conveyor screw according to another embodiment of the present disclosure.
Figure 13:
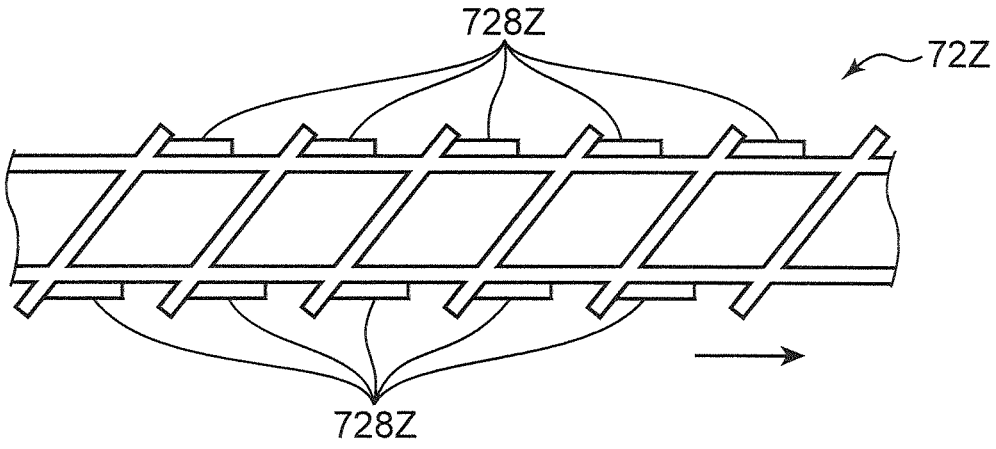
FIG. 13 is a diagram of a conveyor screw according to the other embodiment of the present disclosure.
Figure 14:
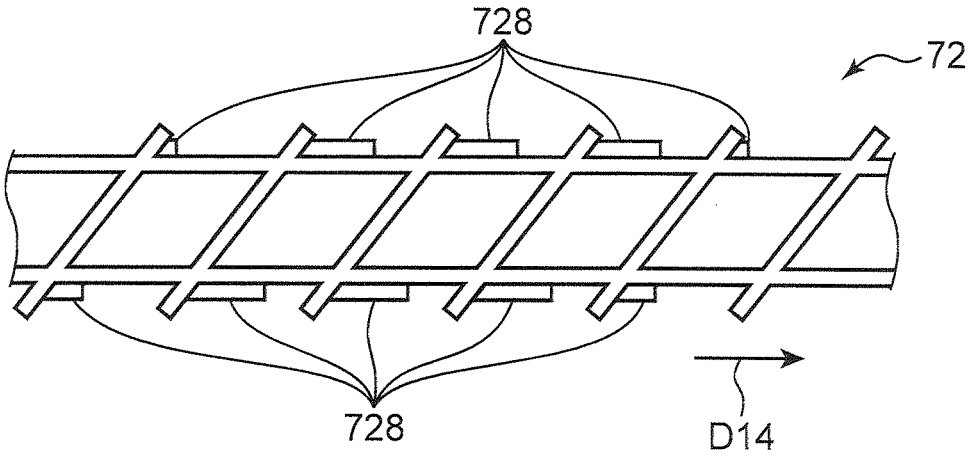
FIG. 14 is a diagram of a conveyor screw according to another embodiment of the present disclosure.
Figure 15:
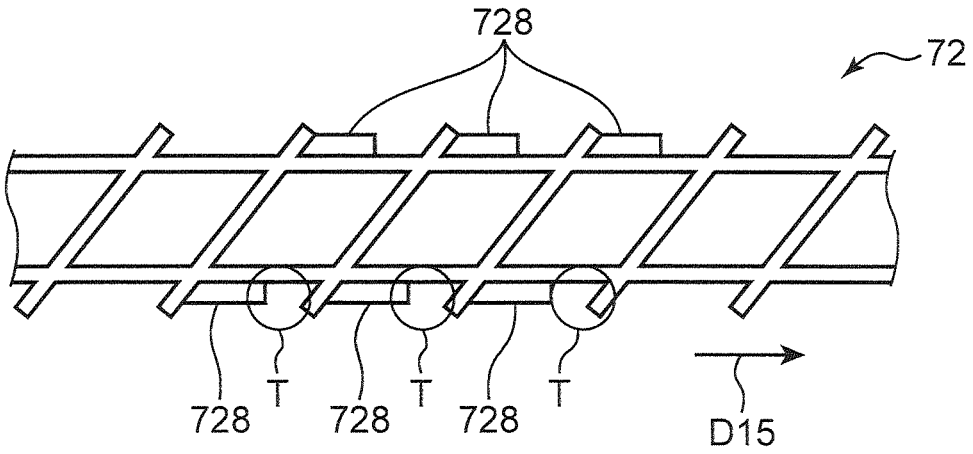
FIG. 15 is a diagram of a conveyor screw according to another embodiment of the present disclosure.

Next, functions and effects of the 11th and 21st projections 728, 738 are described with reference to FIGS. 10 to 15. FIG. 10A is a plan view of the second conveyor screw 73 and FIG. 10B is a front view of the first conveyor screw 72. In FIGS. 10A and 10B, the second and first conveyor screws 73, 72 are respectively rotated in a direction of an arrow D101 and that of an arrow D102. FIG. 11A is a view enlargedly showing an area X of FIG. 10A and FIG. 11B is a view enlargedly showing an area Y of FIG. 10B. FIG. 12 is a diagram showing the arrangement of 21st projections 738Z of a second conveyor screw 73Z according to another embodiment, and FIG. 13 is a diagram showing the arrangement of 11th projections 728Z of a first conveyor screw 72Z according to the other embodiment. FIGS. 14 and 15 are diagrams showing the shapes of 11th projections in modifications of the present invention.

The 11th and 21st projections 728, 738 function to partly restrain the developer conveying performance in the axial directions of the first and second conveyor screws 72, 73. When the second conveyor screw 73 is driven and rotated in the direction of the arrow D101 in FIG. 10A, the developer is mainly conveyed in a direction of an arrow D111 of FIG. 11A. Out of the developer in the second conveying portion 74*b*, the developer arranged in a wedge-shaped part (Z1) between the second screw 731 and the 21st projection 738 is locally moved in a direction of an arrow D112 of FIG. 11A by the second screw 731. However, the developer collides with the 21st projection 738 and moves in a direction of an arrow D113. Specifically, a movement of the developer made in the axial direction by the second screw 731 is translated into a circumferential movement by the 21st projection 738. As a result, a force of axially conveying the developer arranged between the second screw 731 and the 21st projection 738 is reduced. Specifically, the axial conveying performance of the second conveyor screw 73 is partly restrained in correspondence with the parts where the 21st projections 738 are arranged in the axial direction of the second conveyor screw 73.

Similarly, as shown in FIGS. 10B and 11B, the axial conveying performance of the first conveyor screw 72 is partly restrained in correspondence with the parts where the 11th projections 728 are arranged in the axial direction of the first conveyor screw 72. Specifically, when the first conveyor screw 72 is driven and rotated in the direction of the arrow D102 in FIG. 10B, the developer is mainly conveyed in a direction of an arrow D114 of FIG. 11B. Out of the developer in the first conveying portion 74*a*, the developer arranged in a wedge-shaped part (Z2) between the first screw 721 and the 11th projection 728 is locally moved in a direction of an arrow D115 of FIG. 11B by the first screw 721. However, the developer collides with the 11th projection 728 and moves in a direction of an arrow D116. Specifically, a movement of the developer made in the axial direction by the first screw 721 is translated into a circumferential movement by the 11th projection 728.

Particularly, in this embodiment, the second rib 733 is a plate-like member arranged to have a width in a circumferential direction of the rotation of the second screw 731 in FIG. 11A. The 21st projection 738 is arranged substantially in a widthwise (circumferential) central part of the 22nd rib 733. In other words, the 21st projection 738 is located at a position upstream of a downstream end part of the 22nd rib 733 in a rotation direction in the above width direction and projects from the 22nd rib 733 radially outward in the above rotation. Thus, as shown in the area Z1, the developer is temporarily trapped in an area, three sides of which are closed by the 21st projection 738, the 22nd rib 733 and the second screw 731. As a result, the developer moved in the direction of the arrow D112 by the second screw 731 is accurately moved in the direction of the arrow D113 by the 21st projection 738 as described above. At this time, since a radially inward movement of the developer is suppressed by the 22nd rib 733, a movement of the developer into the hollow interior of the first conveyor screw 72 is suppressed. Thus, the developer conveying performance is partly reduced without increasing a pressure in the hollow part. As a result, the cylindrical developer aggregation in the aforementioned hollow interiors is not promoted when the conveying performance is partly restrained in the first and second conveyor screws 72, 73 having the hollow shape.

As just described, in this embodiment, the 11th projections 728 and the 21st projections 738 are arranged, whereby the developer conveying performances of the first and second conveyor screws 72, 73 are partly restrained. Thus, even if the conveying performances of the first and second screws 721, 731 partly differ in the developer storage of the developing device 70, differences in the conveying performances are reduced by arranging the 11th and 21st projections 728, 738. Therefore, the circulatory conveyance of the developer is stably maintained by a simple configuration of the projection members. Further, in the above embodiment, the 21st projections 738 or the 11th projections 728 are arranged in a plurality of areas in the axial direction of the rotation of the second or first screw 731 or 721. Thus, partial differences in the conveying performance in the axial direction are preferably adjusted in the second or first conveyor screw 73 or 72.

Further, in this embodiment, a plurality of ribs, i.e. the 11th and 12th ribs 722, 723 or the 21st and 22nd ribs 732, 733 are arranged at intervals in the circumferential direction of the rotation of the first or second screw 721 or 731. Further, the 11th or 21st projections 728 or 738 are arranged on the 11th and 12th ribs 722, 723 or on the 21st and 22nd ribs 732, 733. Thus, the first or second screw 721 or 731 is stably supported by the 11th and 12th ribs 722, 723 or by the 21st and 22nd ribs 732, 733. Further, the conveying performance of the developer is preferably adjusted even in a range within one pitch of the spiral shape of the first or second screw 721 or 731.

Note that the 11th and 21st projections 728, 738 are arranged on radially outer wall parts of the 12th and 22nd ribs 723, 733. Thus, changes in molds for forming the first and second conveyor screws 72, 73 are suppressed to a minimum level in the case of adding or deleting the 11th and 21st projections 728, 738 as compared with the case where the pitches or outer diameters of the spiral parts of the first and second screws 721, 731 are changed. As a result, a variation in the conveying performance as described above can be restrained while cost of the first and second conveyor screws 72, 73 is suppressed as compared with the case where the pitches or outer diameters of the spiral parts of the first and second screws 721, 731 are partly changed. Particularly, even if the specification of a processing speed (linear speed) is changed in the image forming apparatus 1, the developer conveying performance can be inexpensively adjusted by changing the shapes of the 11th and 21st projections 728, 738.

Note that in another embodiment of the developing device 70, the 21st projections 738Z may be distributed on the second conveyor screw 73Z as shown in FIG. 12 and the 11th projections 728Z may be distributed on the first conveyor screw 72Z as shown in FIG. 13. The developing roller 71 includes a magnet fixedly arranged inside. The developer conveyed in the second conveying portion 74*b* tends to be restricted by a magnetic force of the developing roller 71. Thus, the developer conveying performance in the axial direction of the second conveying portion 74*b* tends to be lower than the developer conveying performance in the axial direction of the first conveying portion 74*a*. In such a case, the developer collides with the 11th projections 728 in the first conveying portion 74*a* more frequently than with the 21st projections 738 arranged in the second conveying portion 74*b* by arranging more 11th projections 728Z of the first conveyor screw 72Z than the 21st projections 738Z of the second conveyor screw 73Z as shown in FIGS. 12 and 13. As a result, the developer conveying performance in the first conveying portion 74*a* is suppressed more. Thus, the developer conveying performances of the first and second conveying portions 74*a*, 74*b* can be approximated. As a result, the developer is stably moved in a circulating manner in the developer storage 74.

Further, a partial variation in the conveying performance of the first conveyor screw 72 can be compensated by setting different shapes for the 11th projections 728 depending on the positions of the first conveyor screw 72 where the 11th projections 728 are arranged as shown in FIGS. 14 and 15. In this case, the axial lengths or radial heights of the 11th projections 728 may be changed.

Further, as described above, the 11th projection 728 projects in the developer conveying direction (arrow D14 of FIG. 14, arrow D15 of FIG. 15) from one spiral part of the first conveyor screw 72 in the axial direction. A tip part of the 11th projection 728 in the conveying direction is arranged between adjacent spiral blades. Thus, as shown in FIG. 15, predetermined clearances T are formed at downstream sides of the axial tip parts of the 11th projections 728 in the conveying direction (arrow D15 of FIG. 15). As a result, a partial variation in the conveying performance caused when the developer is deteriorated and the fluidity thereof is reduced can be prevented. In other words, if the 11th projections 728 extend in the entire areas between adjacent spiral blades of the first conveyor screw 72 in the axial direction, the developer adheres to the 11th projections 728 and the conveying performance is considerably reduced when the fluidity of the developer is reduced to increase an adhesion force of the developer. On the other hand, by forming the clearances T as described above, the stay of an excessive amount of the developer at the same position on the spiral blade is suppressed and the adhesion of the developer is prevented. As a result, a considerable reduction in the conveying performance of the first conveyor screw 72 is suppressed. Note that a configuration similar to the above is applicable also to the 21st projections 738 of the second conveyor screw 73.

Further, in the above embodiment, even if the developer used in the developing device 70 is one-component developer, magnetic toner, having lower fluidity than two-component developer, the conveying performance of the second or first screw 731 or 721 having the hollow shape is partly adjusted by arranging the 21st or 11th projections 738 or 728. Thus, the circulatory conveyance of the developer is stably maintained by the simple configuration of the projection members. Further, in the image forming apparatus 1, the developer is stably supplied from the developing roller 71 to the photoconductive drum 31.

Although the developing device 70 according to the embodiment of the present invention and the image forming apparatus 1 including this have been described above, the present invention is not limited to these and can be, for example, modified as follows.

(1) Although the 21St projections 738 are arranged at the positions upstream of the downstream ends of the 21st and $22^{nd}$ rib 732, 733 in the circumferential rotation direction in the above embodiment, the present invention is not limited to this. The 21st projections 738 may be arranged in any areas in the widths in the circumferential directions of the 21st and $22^{nd}$ ribs 732, 733. Further, the 21st projections 738 may project from the entire width ranges in the circumferential directions of the 21st and $22^{nd}$ ribs 732, 733.

(2) Although the tip part of the $21^{st}$ projection 738 in its extending direction is arranged at a distance from the spiral part of the second screw 731 arranged at a downstream side in the extending direction in the above embodiment, the present invention is not limited to this. The tip part of the $21^{st}$ projection 738 may be connected to the spiral part arranged at the downstream side.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. A developing device, comprising;

a housing with a pair of wall portions;

a developing roller rotatably supported in the housing between the pair of wall portions and configured to carry developer;

a developer supply path arranged along the developing roller and configured such that the developer is conveyed in a first direction and supplied to the developing roller;

a developer conveyance path arranged along the developer supply path and configured such that the developer is conveyed in a second direction opposite to the first direction while being agitated;

a pair of communication paths arranged at inner sides of the pair of wall portions and allowing communication between end parts of the developer conveyance path and end parts of the developer supply path;

a supply-side conveying member including:

a supply-side spiral member having a plurality of spiral revolutions formed about an axis and extending in the first direction and having a hollow interior formed radially inward of the spiral revolutions of the supply-side spiral member;

a first rib member extending in the first direction and bridging adjacent ones of the spiral revolutions of the supply-side spiral member; and a pair of supply-side shaft portions arranged at opposite end parts of the supply-side spiral member, rotatably supported on the wall portions and serving as a rotary shaft for the rotation of the supply-side conveying member, the supply-side conveying member being arranged in the developer supply path and configured to convey the developer in the first direction by being driven and rotated;

an agitating-side conveying member including:

an agitating-side spiral member having a plurality of spiral revolutions formed about an axis and extending in the second direction and having a hollow interior formed radially inward of the spiral revolutions of the agitating-side spiral member;

a second rib member extending in the second direction and bridging adjacent ones of the spiral revolutions of the agitating-side spiral member; and a pair of agitating-side shaft portions arranged at opposite end parts of the agitating-side spiral member, rotatably supported on the wall portions and serving as the rotary shaft for the rotation of the agitating-side conveying member, the agitating-side conveying member being arranged in the developer conveyance path and configured to convey the developer in the second direction by being driven and rotated; and at least one of the supply-side conveying member and the agitating-side conveying member being formed with projecting members, the projecting members including at least one of: first projecting members extending in the first direction along an outer wall portion of the first rib member from a first area where the supply-side spiral member and the first rib member intersect and projecting radially outward in the rotation of the supply-side conveying member; and second projection members extending in the second direction along an outer wall portion of the second rib member from a second area where the agitating-side spiral member and the second rib member intersect and projecting radially outward in the rotation of the agitating-side conveying member, wherein the hollow interior of the supply-side conveying member is formed between the pair of the supply-side shaft portions, the hollow interior of the agitating-side conveying member is formed between the pair of the agitating-side shaft portions, and the supply-side conveying member and the agitating-side conveying member have no other shaft part in each of the hollow interiors thereof.

2. A developing device according to claim 1, wherein:

the supply-side spiral member or the agitating-side spiral member intersects with the first rib member or the second rib member in a plurality of areas in an axial direction of the rotation of the supply-side spiral member or the agitating-side spiral member; and the first projection members or the second projection members extend from the plurality of areas in the axial direction.

3. A developing device according to claim 2, wherein:

the first projection members or the second projection members extend from one and another of the plurality of areas while having different shapes.

4. A developing device according to claim 1, wherein:

a plurality of the first rib members or second rib members are arranged at intervals in a circumferential direction of the rotation of the supply-side spiral member or the agitating-side spiral member; and the first projection members or the second projection members are arranged on each of the plurality of the arranged first rib members or second rib members.

5. A developing device according to claim 1, wherein:

the developing device comprises both the first projection members and the second projection members;

the developing roller includes a magnet fixedly arranged inside; and there are more of the second projection members on the agitating-side conveying member than there are the first projection members on the supply-side conveying member.

6. A developing device according to claim 1, wherein:

a clearance is formed between a tip part of the first projection member or the second projection member in an extending direction of the first projection member or the second projection member and a spiral part arranged at a side downstream of the first area or the second area in the extending direction out of spiral parts of the supply-side spiral member or the agitating-side spiral member.

7. A developing device according to claim 1, wherein:

the first rib member or the second rib member is composed of a plate-like member arranged to have a width in a circumferential direction of the rotation of the supply-side spiral member or the agitating-side spiral member; and the first projection members or the second projection members project radially outward from parts of the first rib member or the second rib member upstream of downstream end parts in a rotation direction of the first rib member or the second rib member.

8. A developing device according to claim 1, wherein:

the developer is composed of one-component developer.

9. An image forming apparatus, comprising:

an image bearing member configured such that an electrostatic latent image is to be formed on a circumferential surface; and a developing device for supplying developer to the image bearing member;

wherein the developing device includes:

a housing with a pair of wall portions;

a developing roller rotatably supported in the housing between the pair of wall portions and configured to carry the developer;

a developer supply path arranged along the developing roller and configured such that the developer is conveyed in a first direction and supplied to the developing roller;

a developer conveyance path arranged along the developer supply path and configured such that the developer is conveyed in a second direction opposite to the first direction while being agitated;

a pair of communication paths arranged at inner sides of the pair of wall portions and allowing communication between end parts of the developer conveyance path and end parts of the developer supply path;

a supply-side conveying member including:

a supply-side spiral member having a plurality of spiral revolutions formed about an axis and extending in the first direction and having a hollow interior formed radially inward of the spiral revolutions of the supply-side spiral member;

a first rib member extending in the first direction and bridging adjacent ones of the spiral pieces of the supply-side spiral member; and a pair of supply-side shaft portions arranged at opposite end parts of the supply-side spiral member, rotatably supported on the wall portions and serving as a rotary shaft for the rotation of the supply-side conveying member, the supply-side conveying member being arranged in the developer supply path and configured to convey the developer in the first direction by being driven and rotated;

an agitating-side conveying member including:

an agitating-side spiral member having a plurality of spiral revolutions formed about an axis and extending in the second direction and having a hollow interior formed radially inward of the spiral revolutions of the agitating-side spiral member;

a second rib member extending in the second direction and bridging adjacent ones of the spiral pieces of the agitating-side spiral member;

a pair of agitating-side shaft portions arranged at opposite end parts of the agitating-side spiral member, rotatably supported on the wall portions and serving as the rotary shaft for the rotation of the agitating-side conveying member, the agitating-side conveying member being arranged in the developer conveyance path and configured to convey the developer in the second direction by being driven and rotated; and at least one of the supply-side conveying member and the agitating-side conveying member being formed with projecting members, the projecting members including at least one of: first projecting members extending in the first direction along an outer wall portion of the first rib member from a first area where the supply-side spiral member and the first rib member intersect and projecting radially outward in the rotation of the supply-side conveying member; and second projection members extending in the second direction along an outer wall portion of the second rib member from a second area where the agitating-side spiral member and the second rib member intersect and projecting radially outward in the rotation of the agitating-side conveying member, wherein the hollow interior of the supply-side conveying member is formed between the pair of the supply-side shaft portions, the hollow interior of the agitating-side conveying member is formed between the pair of the agitating-side shaft portions, and the supply-side conveying member and the agitating-side conveying member have no other shaft part in each of the hollow interiors thereof.

10. An image forming apparatus according to claim 9, wherein:

the supply-side spiral member or the agitating-side spiral member intersects with the first rib member or the second rib member in a plurality of areas in an axial direction of the rotation of the supply-side spiral member or the agitating-side spiral member; and the first projection members or the second projection members extend from the plurality of areas in the axial direction.

11. An image forming apparatus according to claim 10, wherein:

the first projection members or the second projection members extend from one and another of the plurality of areas while having different shapes.

12. An image forming apparatus according to claim 9, wherein:

a plurality of the first rib members or second rib members are arranged at intervals in a circumferential direction of the rotation of the supply-side spiral member or the agitating-side spiral member; and the first projection members or the second projection members are arranged on each of the plurality of the arranged first rib members or second rib members.

13. An image forming apparatus according to claim 9, wherein:

the developing device comprises both the first projection members and the second projection members;

the developing roller includes a magnet fixedly arranged inside; and there are more of the second projection members on the agitating-side conveying member than there are the first projection members on the supply-side conveying member.

14. An image forming apparatus according to claim 9, wherein:

a clearance is formed between a tip part of the first projection member or the second projection member in an extending direction of the first projection member or the second projection member and a spiral part arranged at a side downstream of the first area or the second area in the extending direction out of spiral parts of the supply-side spiral member or the agitating-side spiral member.

15. An image forming apparatus according to claim 9, wherein:

the first rib member or the second rib member is composed of a plate-like member arranged to have a width in a circumferential direction of the rotation of the supply-side spiral member or the agitating-side spiral member; and the first projection members or the second projection members project radially outward from parts of the first rib member or the second rib member upstream of downstream end parts in a rotation direction of the first rib member or the second rib member.

16. An image forming apparatus according to claim 9, wherein:

the developer is composed of one-component developer.

* * * * *